US009802418B2

(12) United States Patent
Nagashima

(10) Patent No.: US 9,802,418 B2
(45) Date of Patent: Oct. 31, 2017

(54) LIQUID CONTAINER AND PROTECTION MEMBER

(71) Applicant: SEIKO EPSON CORPORATION, Tokyo (JP)

(72) Inventor: Takumi Nagashima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/357,232

(22) Filed: Nov. 21, 2016

(65) Prior Publication Data

US 2017/0151800 A1 Jun. 1, 2017

(30) Foreign Application Priority Data

Nov. 27, 2015 (JP) ..... 2015-231542

(51) Int. Cl.
*B41J 2/175* (2006.01)
*B41J 29/13* (2006.01)
*B65D 59/06* (2006.01)

(52) U.S. Cl.
CPC ..... *B41J 2/17536* (2013.01); *B41J 2/1752* (2013.01); *B41J 2/1754* (2013.01);
(Continued)

(58) Field of Classification Search
CPC .. B41J 2/17503; B41J 2/17509; B41J 2/1752; B41J 2/17526; B41J 2/17536;
(Continued)

(56) References Cited

U.S. PATENT DOCUMENTS 5,825,388 A * 10/1998 Sasaki ..... B41J 2/17553 347/86
6,623,104 B1 * 9/2003 Kotaki ..... B41J 2/17513 347/49

(Continued)

FOREIGN PATENT DOCUMENTS

JP 2014-050963 A 3/2014
JP 2014-097577 A 5/2014
JP 2015-199227 A 11/2015

*Primary Examiner* — Anh T. N. Vo
(74) *Attorney, Agent, or Firm* — Foley & Lardner LLP

(57) ABSTRACT

A liquid container includes a liquid container body and a protection member that is attached to the liquid container body. The liquid container body includes: a liquid supply port; a plurality of contact parts that are to be in contact with an electrode part; a first engagement-target part; and a second engagement-target part. The protection member includes: a sealing part that faces the liquid supply port; a first engaging part that engages with the first engagement-target part; and a second engaging part that engages with the second engagement-target part. A first direction denotes a direction in which the sealing part faces the liquid supply port, a second direction denotes a direction that is orthogonal to the first direction and is a direction from the liquid supply port to the plurality of contact parts, and a third direction denotes a direction that is orthogonal to the first direction and the second direction. The plurality of contact parts viewed in the first direction are located between the first engaging part and the second engaging part in terms of the third direction.

14 Claims, 25 Drawing Sheets

(52) U.S. Cl.
CPC ..... *B41J 2/17503* (2013.01); *B41J 2/17509* (2013.01); *B41J 2/17553* (2013.01); *B41J 2/17559* (2013.01); *B41J 29/13* (2013.01); *B65D 59/06* (2013.01)

(58) Field of Classification Search
CPC .. B41J 2/1754; B41J 2/17553; B41J 2/17559; B41J 29/13; B65D 59/06
See application file for complete search history.

(56) References Cited

U.S. PATENT DOCUMENTS

| | | | | |
|---|---|---|---|---|
| 7,237,881 | B2 * | 7/2007 | Hayasaki | B41J 2/17546 347/19 |
| 7,690,774 | B2 * | 4/2010 | Petranek | B41J 2/17513 347/86 |
| 7,938,523 | B2 * | 5/2011 | Aldrich | B41J 2/17513 347/84 |
| 8,684,505 | B2 * | 4/2014 | Campbell-Brown | B41J 2/19 347/49 |
| 2013/0314479 | A1 | 11/2013 | Nozawa et al. | |
| 2015/0022599 | A1 | 1/2015 | Nozawa et al. | |
| 2015/0284159 | A1 | 10/2015 | Yamada et al. | |

* cited by examiner

TO FIG. 16

LIQUID CONTAINER AND PROTECTION MEMBER

BACKGROUND

1. Technical Field

The present invention relates to a liquid container and a protection member.

2. Related Art

One mode of a liquid container is, for example, an ink cartridge to which a cap member has been attached. An ink cartridge is one mode of a liquid container body, and stores ink that is to be supplied to an inkjet printer (hereinafter simply referred to as "printer") that is one mode of a liquid ejection apparatus. In some cases, a cap member that serves as a protection member is attached to the ink cartridge in the phase where the ink cartridge is unused such as before distributing onto the market, in order to prevent damage and ink leakage during transportation (see JP-A-2014-050963, for example).

Preferably, the configuration of the cap member of the ink cartridge is appropriately modified according to the configuration of the ink cartridge. For example, the ink cartridge is usually provided with a board for exchanging electrical signals with the printer, and components for attachment to the printer, such as a positioning part for determining the orientation and the position of the ink cartridge when attached to the printer. It is preferable that the cap member of the ink cartridge is improved in terms of protection against the aforementioned components for attachment to the printer, in addition to preventing damage to the ink cartridge per se and ink leakage as described above. Also, it is preferable that the cap member is improved in terms of attachability to the ink cartridge, such as being made easier to be attached to the ink cartridge.

SUMMARY

The invention is not limited to an ink cartridge provided with a cap member, and an advantage of some modes of the invention is to solve at least some of the above-described problems in the liquid container and the protection member thereof, and the invention may be implemented in the following modes.

[1] A first mode of the invention provides a liquid container. The liquid container may include a liquid container body and a protection member. The liquid container body may supply a liquid to a liquid ejection apparatus. The protection member may be attached to the liquid container body. The liquid container body may include a liquid supply port, a plurality of contact parts, a first engagement-target part, and a second engagement-target part. The liquid supply port may be configured to allow the liquid to pass therethrough. The plurality of contact parts may be in contact with an electrode part of the liquid ejection apparatus. The first engagement-target part and the second engagement-target part may be engaged with the protection member. The protection member may include a sealing part, a first engaging part, and a second engaging part. The sealing part may face the liquid supply port. The first engaging part may engage with the first engagement-target part. The second engaging part may engage with the second engagement-target part. A first direction denotes a direction in which the sealing part faces the liquid supply port, a second direction denotes a direction that is orthogonal to the first direction and is a direction from the liquid supply port to the plurality of contact parts, and a third direction denotes a direction that is orthogonal to the first direction and the second direction. The plurality of contact parts viewed in the first direction may be located between the first engaging part and the second engaging part in terms of the third direction. With the liquid container according to this mode, when attaching the protection member to the liquid container body, it is possible to easily determine the positions of the first engaging part and the second engaging part with reference to the positions of the plurality of contact parts, and therefore it is easier to attach the protection member to the liquid container body. Also, due to the presence of the engaging parts, the plurality of contact parts that the liquid container body has are further protected.

[2] In the liquid container according to the above-described mode, the distance between the first engaging part and the second engaging part in the third direction may be greater than a maximum distance between the plurality of contact parts in the third direction, and a difference between: the distance between the first engaging part and the second engaging part in the third direction; and the maximum distance between the plurality of contact parts in the third direction may be smaller than the width of the first engagement-target part in the third direction. With the liquid container according to this mode, the corresponding engaging parts and the engagement-target parts can easily engage with each other, and it is even easier to attach the protection member to the liquid container body.

[3] In the liquid container according to the above-described mode, the liquid container body may include a board on which the plurality of contact parts are arranged, and when viewed in the first direction, the board may be located between the first engaging part and the second engaging part in terms of the third direction. With the liquid container according to this mode, when attaching the protection member to the liquid container body, it is possible to easily determine the positions of first engaging part and the second engaging part with reference to the position of the board. Also, the board that the liquid container body has is further protected.

[4] In the liquid container according to the above-described mode, the distance between the first engaging part and the second engaging part in the third direction may be greater than the width of the board in the third direction, and a difference between: the distance between the first engaging part and the second engaging part in the third direction; and the width of the board in the third direction may be smaller than the width of the first engagement-target part in the third direction. With the liquid container according to this mode, the attachability of the protection member to the liquid container body is improved, and the board of the liquid container body is further protected by the protection member.

[5] In the liquid container according to the above-described mode, $W2<D1+D2<W1+W2$ may be satisfied, where D1 denotes the distance between the board and the first engaging part in the third direction, D2 denotes the distance between the board and the second engaging part in the third direction, W1 denotes the width of the first engagement-target part in the third direction, and W2 denotes the distance between the board and the first engagement-target part in the third direction. With the liquid container according to this mode, it is easier to attach the protection member to the liquid container body, and the attachability of the protection member to the liquid container body is improved.

[6] In the liquid container according to the above-described mode, the width of the first engaging part in the third direction may be greater than the distance between the board and the first engagement-target part in the third direction. With the liquid container according to this mode, the attachability of the protection member to the liquid container body is further improved.

[7] In the liquid container according to the above-described mode, the width of the second engaging part in the third direction may be greater than the distance between the board and the second engagement-target part in the third direction. With the liquid container according to this mode, the attachability of the protection member to the liquid container body is further improved.

[8] In the liquid container according to the above-described mode, the liquid container body may further include a positioning part that determines a position of the liquid container body when attached to the liquid ejection apparatus, and in terms of the second direction, the positioning part may be located between the liquid supply port and the plurality of contact parts, and between the liquid supply port and a pair of the first engagement-target part and the second engagement-target part, and may be covered by a portion of the protection member. With the liquid container according to this mode, the positioning part improves the electrical connectability, with the liquid ejection apparatus, of the plurality of contact parts, and due to the presence of the protection member, the positioning part is further protected.

[9] In the liquid container according to the above-described mode, the liquid container body may further include: a fitting part that has a shape corresponding to a shape of a fitting-target part of the liquid ejection apparatus, and that fits to the fitting-target part; and a third engagement-target part and a fourth engagement-target part that engage with the protection member, the protection member may further include third engaging part that engages with the third engagement-target part; and a fourth engaging part that engages with the fourth engagement-target part, and when viewed in the first direction, the liquid supply port may be located between the plurality of contact parts and the fitting part in terms of the second direction, and the fitting part may be located between the third engaging part and the fourth engaging part in terms of the third direction. With the liquid container according to this mode, the four engaging parts improve the attachability and stability of the protection member with respect to the liquid container body. Also, it is possible to easily position the third engaging part and the fourth engaging part with reference to the position of the fitting part, and therefore it is possible to provide convenience to the user when attaching the protection member to the liquid container body.

[10] In the liquid container according to the above-described mode, when viewed in the first direction, the liquid supply port may be located within an area that is surrounded by the first engaging part, the second engaging part, the third engaging part, and the fourth engaging part. With the liquid container according to this mode, the sealability of the sealing part of the protection member with respect to the liquid supply port is improved, and the liquid is prevented from leaking from the liquid container body.

[11] In the liquid container according to the above-described mode, the liquid container body may include: a first wall part; a second wall part that faces the first wall part; a third wall part that intersects the first wall part and the second wall part; a fourth wall part that intersects the first wall part and the second wall part, and faces the third wall part; a fifth wall part that intersects the first wall part, the second wall part, the third wall part, and the fourth wall part; a sixth wall part that intersects the first wall part, the second wall part, the third wall part, and the fourth wall part, and faces the fifth wall part; and a seventh wall part that intersects the first wall part, the second wall part, the fifth wall part, and the sixth wall part, and is located between the first wall part and the fourth wall part, the liquid supply port, the first engagement-target part, and the second engagement-target part may be provided for the first wall part, the plurality of contact parts may be provided for the seventh wall part, the third wall part may be provided with a rib, the rib may include a first portion that extends in the third direction and a second portion that extends toward the first wall part from the first portion, the protection member may include: a main body part that faces the first wall part; and a movable part that is connected to the main body part. The sealing part, the first engaging part, and the second engaging part may be provided for the main body part, the movable part may be provided with an operation part that is used for removing the protection member from the liquid container body, and a portion of the movable part may abut against the second portion in the first direction. With the liquid container according to this mode, the sealability of the sealing part with respect to the liquid supply port is prevented from being degraded due to the sealing part being excessively compressed by the protection member and the liquid container body.

[12] A second mode of the invention provides a liquid container. The liquid container according to this mode may include a liquid container body and a protection member. The liquid container body may supply a liquid to a liquid ejection apparatus. The protection member may be attached to the liquid container body. The liquid container body may include a liquid supply port, a plurality of contact parts, a positioning part, a first engagement-target part, and a second engagement-target part. The liquid supply port may be configured to allow the liquid to pass therethrough. The plurality of contact parts may be in contact with an electrode part of the liquid ejection apparatus. The positioning part may determine the position of the liquid container body when attached to the liquid ejection apparatus. The first engagement-target part and the second engagement-target part may be engaged with the protection member. The protection member may include a sealing part, a first engaging part, and a second engaging part. The sealing part may face the liquid supply port. The first engaging part may engage with the first engagement-target part. The second engaging part may engage with the second engagement-target part. A first direction denotes a direction in which the sealing part faces the liquid supply port, a second direction denotes a direction that is orthogonal to the first direction and is a direction from the liquid supply port to the plurality of contact parts, and a third direction denotes a direction that is orthogonal to the first direction and the second direction. In terms of the second direction, the positioning part may be located between the liquid supply port and the plurality of contact parts, and between the liquid supply port and a pair of the first engagement-target part and the second engagement-target part, and may be covered by a portion of the protection member. With the liquid container according to this mode, the positioning part improves the electrical connectability, with the liquid ejection apparatus, of the plurality of contact parts, and due to the presence of the protection member, the positioning part is further protected.

[13] A third mode of the invention provides a liquid container. The liquid container according to this mode may include a liquid container body and a protection member. The liquid container body may supply a liquid to a liquid ejection apparatus. The protection member may be attached to the liquid container body. The liquid container body may include a liquid supply port, a plurality of contact parts, a fitting part, and a pair of engagement-target parts. The liquid supply port may be configured to allow the liquid to pass therethrough. The plurality of contact parts may be in contact with an electrode part of the liquid ejection apparatus. The fitting part may have a shape corresponding to the shape of a fitting-target part of the liquid ejection apparatus, and fit to the fitting-target part. The pair of engagement-target parts may be engaged with the protection member. The protection member may include a sealing part and a pair of engaging parts. The sealing part may face the liquid supply port. The pair of engaging parts may respectively engage with the pair of engagement-target parts. A first direction denotes a direction in which the sealing part faces the liquid supply port, a second direction denotes a direction that is orthogonal to the first direction and is a direction from the liquid supply port to the plurality of contact parts, and a third direction denotes a direction that is orthogonal to the first direction and the second direction. When viewed in the first direction, the liquid supply port may be located between the plurality of contact parts and the fitting part in terms of the second direction, and the fitting part may be located between the pair of engaging parts in terms of the third direction. With the liquid container according to this mode, the fitting part improves the attachability of the liquid container body to the liquid ejection apparatus. Also, when attaching the protection member to the liquid container body, it is possible to easily determine the position of the engaging part with reference to the position of the fitting part, and therefore it is possible to provide convenience to the user when attaching the protection member to the liquid container body.

[14] In the liquid container according to the above-described mode, the pair of engaging parts may each have a shape that protrudes toward the liquid container body in the third direction, and may be configured to abut against the liquid container body before coming into contact with the pair of engagement-target parts during a process in which the protection member is attached to the liquid container body. With the liquid container according to this mode, during the process of attaching the protection member to the liquid container body, the pair of engaging parts serve as guides, and the attachability of the protection member to the liquid container body is improved.

[15] A fourth mode of the invention provides a liquid container. The liquid container according to this mode may include a liquid container body and a protection member. The liquid container body may supply a liquid to a liquid ejection apparatus. The protection member may be attached to the liquid container body. The liquid container body may include a liquid supply port, a plurality of contact parts, a first engagement-target part, a second engagement-target part, a third engagement-target part, and a fourth engagement-target part. The liquid supply port may be configured to allow the liquid to pass therethrough. The plurality of contact parts may be in contact with an electrode part of the liquid ejection apparatus. The first engagement-target part, the second engagement-target part, the third engagement-target part, and the fourth engagement-target part may be engaged with the protection member. The protection member may include a sealing part, a first engaging part, a second engaging part, a third engaging part, and a fourth engaging part. The sealing part may face the liquid supply port. The first engaging part may engage with the first engagement-target part. The second engaging part may engage with the second engagement-target part. The third engaging part may engage with the third engagement-target part. The fourth engaging part may engage with the fourth engagement-target part. When viewed in a first direction that is a direction in which the sealing part faces the liquid supply port, the liquid supply port may be located within an area that is surrounded by the first engaging part, the second engaging part, the third engaging part, and the fourth engaging part. With the liquid container according to this mode, the attachability of the protection member to the liquid container body is improved, the sealability of the protection member with respect to the liquid supply port is improved, and the liquid is prevented from leaking from the liquid container body.

[16] In the liquid container according to the above-described mode, when viewed in the first direction, the liquid container body may have an outer peripheral wall part that surrounds the liquid supply port, and the outer peripheral wall part may be in contact with the sealing part in the first direction. With the liquid container according to this mode, the liquid is further prevented from leaking from the liquid supply port.

[17] A fifth mode of the invention provides a protection member that is to be attached to a liquid container. The liquid container may include: a liquid supply port that allows a liquid to pass therethrough; and a plurality of contact parts that are to be in contact with an electrode part of a liquid ejection apparatus. The protection member may include a sealing part, a first engaging part, and a second engaging part. The sealing part may face the liquid supply port. The first engaging part may engage with a first engagement-target part that the liquid container body has. The second engaging part may engage with a second engagement-target part that the liquid container body has. In the state where the protection member has been attached to the liquid container body, a first direction denotes a direction in which the sealing part faces the liquid supply port, a second direction denotes a direction that is orthogonal to the first direction and is a direction from the liquid supply port to the plurality of contact parts, and a third direction denotes a direction that is orthogonal to the first direction and the second direction. The plurality of contact parts viewed in the first direction may be located between the first engaging part and the second engaging part in terms of the third direction. With the protection member according to this mode, when attaching the protection member to the liquid container body, it is possible to easily determine the positions of the first engaging part and the second engaging part with reference to the positions of the plurality of contact parts. Also, it is possible to improve protection for the plurality of contact parts of the liquid container body.

[18] In the protection member according to the above-described mode, the liquid container body may include a board on which the plurality of contact parts are arranged, the distance between the first engaging part and the second engaging part in the third direction may be greater than the width of the board in the third direction, and the difference between: the distance between the first engaging part and the second engaging part in the third direction; and the width of the board in the third direction may be smaller than the width of the first engagement-target part in the third direction. With the liquid container according to this mode, the attachability of the protection member to the liquid container body is further improved.

[19] In the protection member according to the above-described mode, the liquid container body may further include: a fitting part that has a shape corresponding to a shape of a fitting-target part of the liquid ejection apparatus, and that fits to the fitting-target part; and a third engagement-target part and a fourth engagement-target part that engage with the protection member. The protection member may further include: a third engaging part that engages with the third engagement-target part; and a fourth engaging part that engages with the fourth engagement-target part. When viewed in the first direction, the liquid supply port may be located between the plurality of contact parts and the fitting part in terms of the second direction, and the fitting part may be located between the third engaging part and the fourth engaging part in terms of the third direction. With the protection member according to this mode, the four engaging parts improve the attachability and stability of the protection member with respect to the liquid container body. Also, when attaching the protection member to the liquid container body, it is possible to determine the positions of the third engaging part and the fourth engaging part with reference to the position of the fitting part, and therefore it is easier to attach the protection member to the liquid container body.

The constituent elements included according to the above-described modes of the invention are not all essential, and in order to solve some or all of the above-described problems or achieve some or all of the advantageous effects described in this specification, some of the constituent elements can be modified, omitted, and replaced with other constituent elements as necessary, and the limiting content can be partially omitted. Also, in order to solve some or all of the above-described problems or achieve some or all of the above-described advantageous effects, some or all of the technical features in any of the above-described modes of the invention can be combined with some or all of the technical features included in another one of the above-described modes of the invention so as to obtain an independent mode of the invention.

The invention can be realized in modes other than the modes of liquid container and protection member, and can be realized in, for example, modes of a method and a structure for attaching a protection member to a liquid container body, a method for manufacturing a liquid container, and so on.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Overview of Cartridge Provided with Protection Cap

Figure 1:
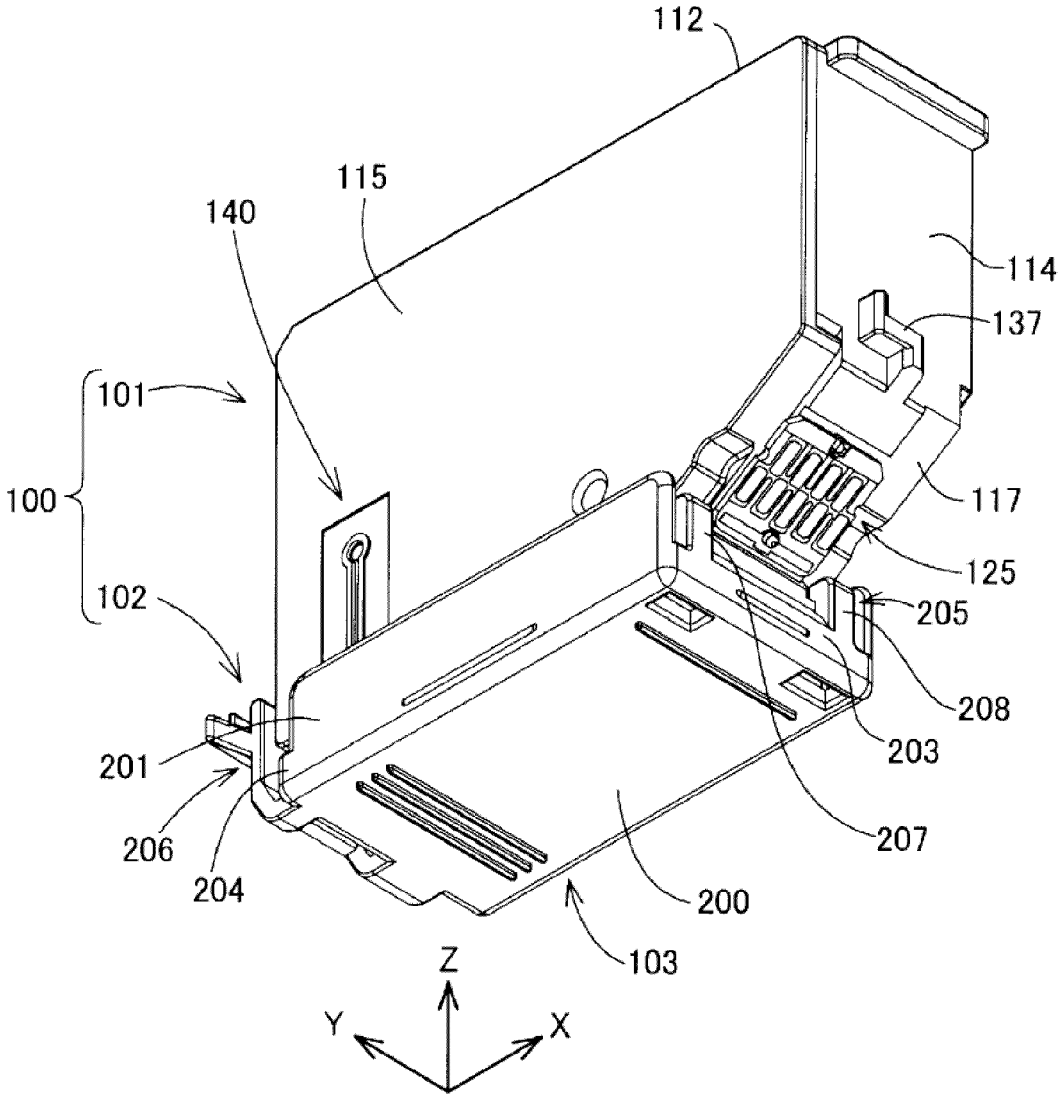
FIG. 1 is a schematic perspective view showing a protection-cap-equipped cartridge according to a first embodiment.
Figure 2:
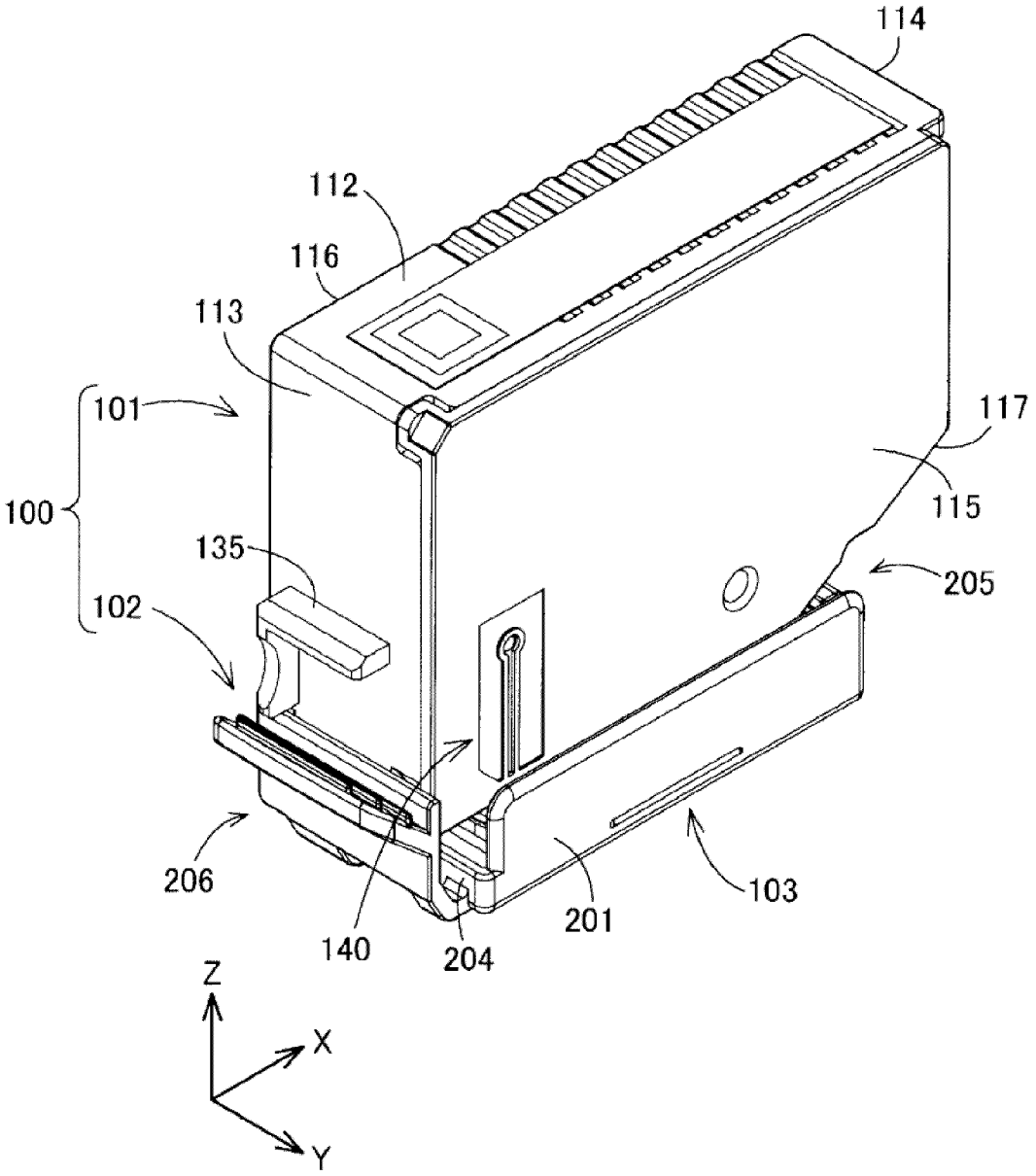
FIG. 2 is a schematic perspective view showing the cartridge provided with the protection cap according to the first embodiment viewed in another direction.

FIGS. 1 and 2 are schematic perspective views showing a protection-cap-equipped cartridge 100 (a cartridge 100 that is provided with a protection cap) according to a first embodiment of the invention. FIG. 1 shows the protection-cap-equipped cartridge 100 viewed from obliquely below. FIG. 2 shows the protection-cap-equipped cartridge 100 viewed from obliquely above. Descriptions regarding directions in which the cartridge 100 of the protection cap is viewed, such as "above" and "below" mentioned above, correspond to directions with reference to the position of an ink cartridge 101 described below. FIG. 1 and FIG. 2 show arrows X, Y, and Z that are orthogonal to each other and indicate directions with reference to the position of the ink cartridge 101. The arrows X, Y, and Z correspond to the arrows X, Y, and Z shown in the drawings that are referred to in the descriptions below. The directions indicated by the arrows X, Y, and Z will be described later.

The protection-cap-equipped cartridge 100 is constituted by the ink cartridge 101 (hereinafter simply referred to as "the cartridge 101" as well) in the state where a protection cap 102 has been attached thereto. The protection-cap-equipped cartridge 100 is one embodiment of the liquid container according to the invention. The cartridge 101 is a liquid container body in which ink to be supplied to an inkjet printer (hereinafter simply referred to as "the printer" as well) is stored. The cartridge 101 is to be detachably attached to the carriage (described below) of the printer. The protection cap 102 is a protection member to be attached to the cartridge 101 in an unused state before factory shipment, and is removed by the user before the cartridge 101 is attached to the printer.

In the following description, the configuration of the cartridge 101 will be described, and thereafter the configuration of the protection cap 102 will be described. Subsequently, the process of attaching the protection cap 102 to the cartridge 101 will be described, and the details of the attached state of the protection cap 102 in the protection-cap-equipped cartridge 100 will be described. Thereafter, the attachment of the cartridge 101 to the printer will also be described.

Configuration of Cartridge

The configuration of the cartridge 101 will be described with reference to FIGS. 3 to 10. The cartridge 101 according to the present embodiment is a so-called semi-sealed ink cartridge, and has a configuration in which external air is intermittently introduced to the inside while ink is consumed. In the following description, the configuration of the cartridge 101 in terms of the appearance thereof will be described, thereafter the internal configuration thereof will be described, and then the mechanism by which the cartridge 101 takes in external air will be described.

Configuration of Cartridge in Terms of Appearance

Figure 3:
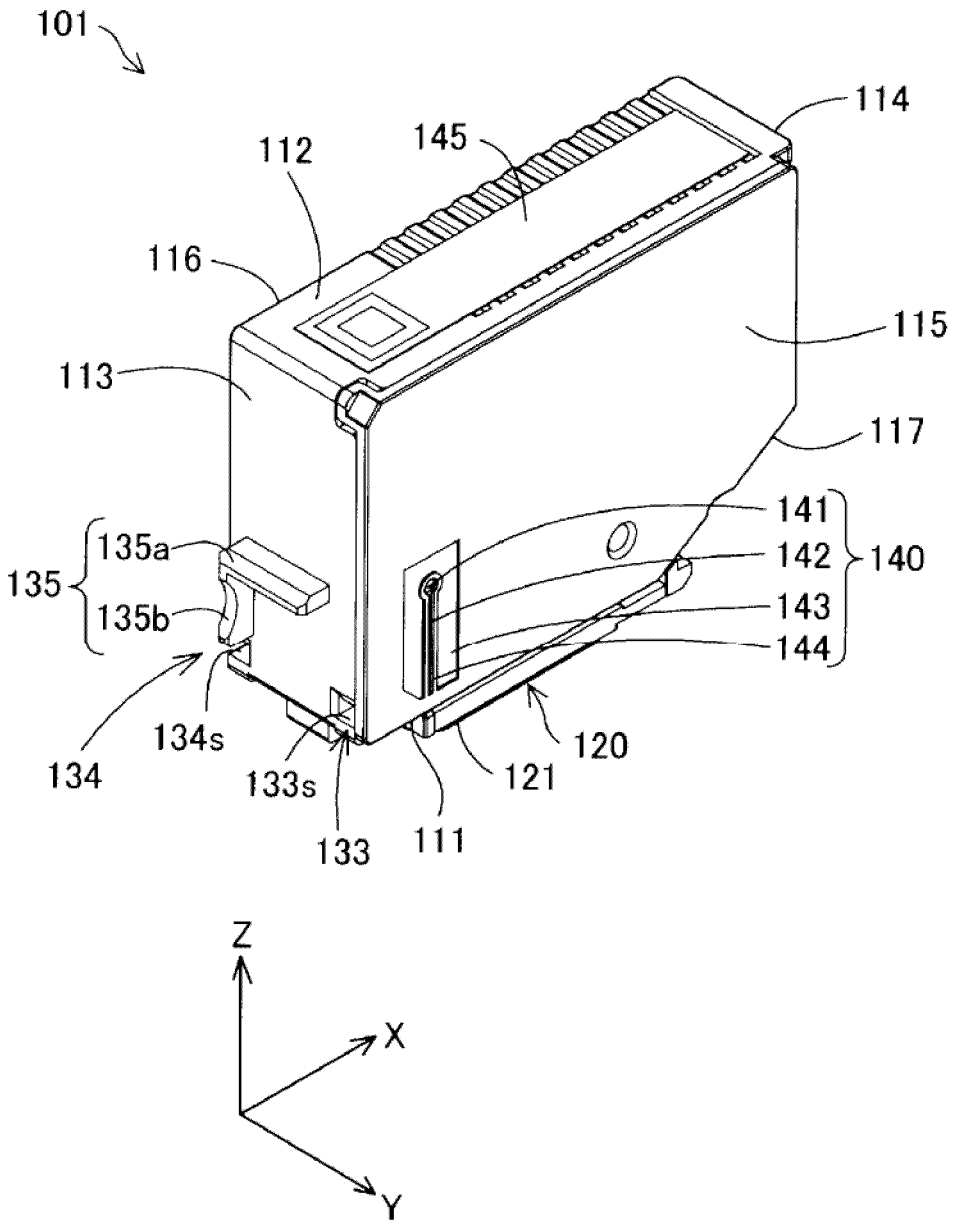
FIG. 3 is a schematic perspective view showing a front side of the cartridge according to the first embodiment.
Figure 4:
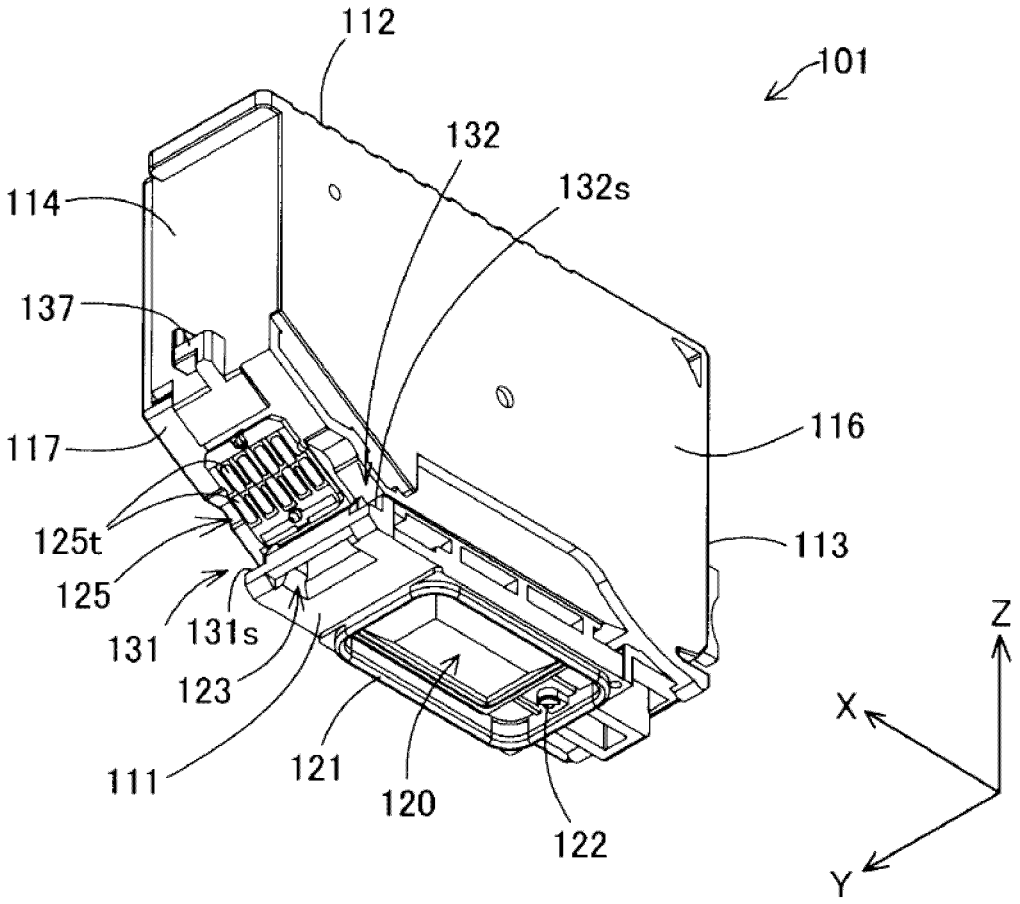
FIG. 4 is a schematic perspective view showing a rear side of the cartridge according to the first embodiment.
Figure 5:
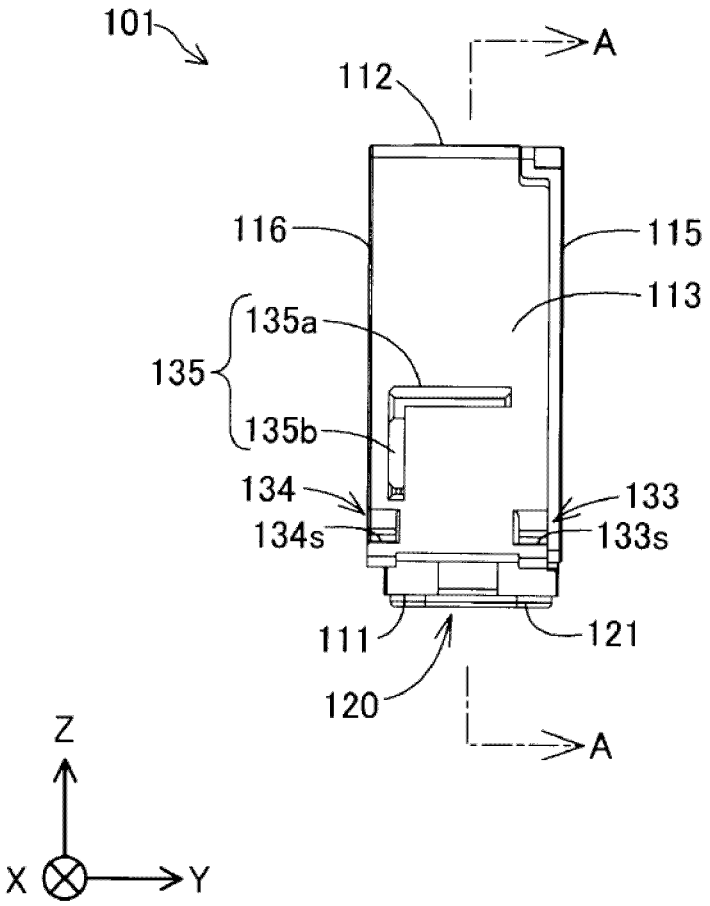
FIG. 5 is a schematic front view of the cartridge according to the first embodiment.
Figure 6:
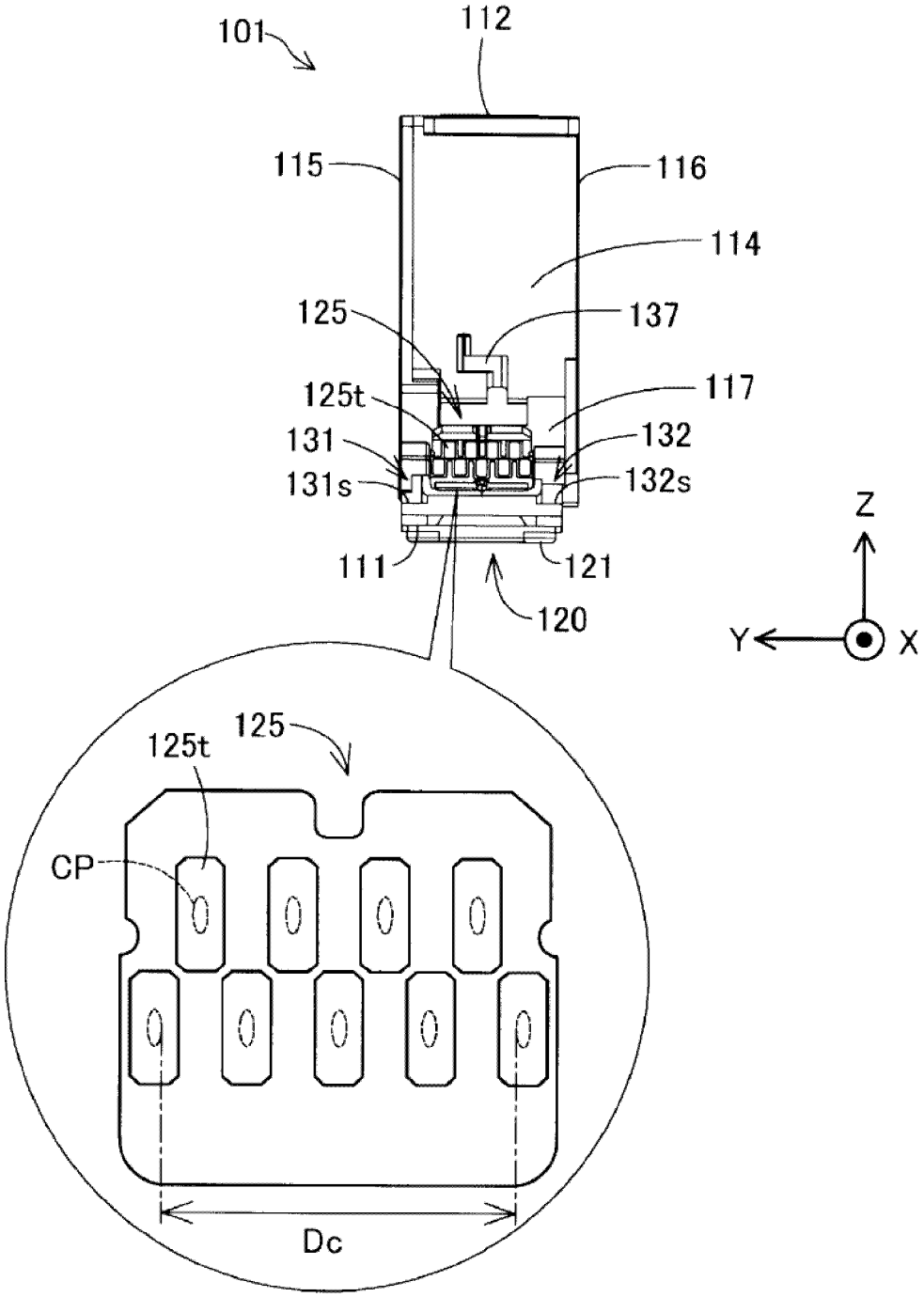
FIG. 6 is a schematic rear view of the cartridge according to the first embodiment.
Figure 7:
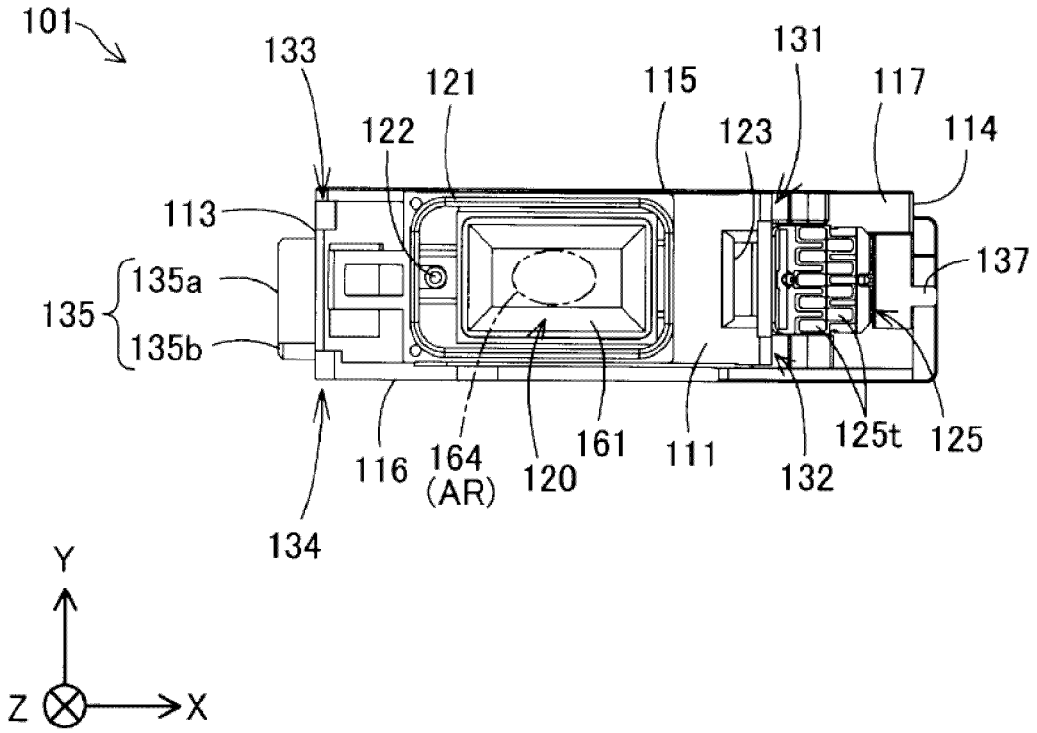
FIG. 7 is a schematic bottom view of the cartridge according to the first embodiment.

FIG. 3 is a schematic perspective view showing the front side of the cartridge 101 viewed from obliquely above. FIG. 4 is a schematic perspective view showing the rear side of the cartridge 101 viewed from obliquely below. FIG. 5 is a schematic left-side view of the cartridge 101. FIG. 6 is a schematic right-side view of the cartridge 101. In FIG. 6, a close-up of a board part 125 of the cartridge 101 is shown in a balloon. FIG. 7 is a schematic bottom view of the cartridge 101.

The cartridge 101 has an approximately polyhedral shape constituted by seven wall parts 111 to 117 (FIGS. 3 and 4). In the present description, "wall parts" are not limited to flat wall parts, and may be curved or have a bent portion or a step portion, and may have a recessed portion, a protruding portion, a groove, a slope, or the like on the surface thereof.

A first wall part 111 is a wall part that constitutes the bottom surface of the cartridge 101 when attached to the carriage of the printer (FIGS. 4 and 7). A second wall part 112 is located so as to face the first wall part 111, and is a wall part that constitutes the upper surface of the cartridge 101 when attached to the carriage of the printer (FIG. 5). In the present description, when walls "face" each other, the walls directly face each other, or indirectly face each other with another member interposed therebetween.

A third wall part 113 is a wall part that extends between the first wall part 111 and the second wall part 112, and intersects the first wall part 111 and the second wall part 112 (FIGS. 3 and 5). In the present description, "extend" means to continuously extend in a given direction. A wall that "extends" may extend in a given direction and be bent or curved at a given point. Also, in the present description, when two walls "intersect" each other, the two walls actually intersect each other, or one of the walls is located at a position toward which the other wall extends, or the directions in which the two walls extend intersect each other. Therefore, a chamfered portion that constitutes a curved surface may be interposed between walls that intersect each other.

A fourth wall part 114 is a wall part that extends from the second wall part 112 in a direction in which the second wall part 112 faces the first wall part 111, that faces the third wall part 113, and intersects the first wall part 111 and the second wall part 112 (FIGS. 4 and 6). A fifth wall part 115 is a wall part that intersects the first wall part 111, the second wall part 112, the third wall part 113, and the fourth wall part 114 (FIG. 3). A sixth wall part 116 is a wall part that faces the fifth wall part 115 and intersects the first wall part 111, the second wall part 112, the third wall part 113, and the fourth wall part 114 (FIG. 4). A seventh wall part 117 is a wall part that obliquely extends between the first wall part 111 and the fourth wall part 114, and intersects the first wall part 111, the second wall part 112, the fifth wall part 115, and the sixth wall part 116 (FIGS. 4 and 6).

In the present description, for the sake of convenience, the surface of the cartridge 101 constituted by the fifth wall part 115 is referred to as "the front surface", and the surface constituted by the sixth wall part 116 is referred to as "the rear surface". The surfaces that are constituted by the fourth wall part 114 and the seventh wall part 117, which are located on the right side in front view of the fifth wall part 115, are referred to as "right-side surfaces", and the surface that is constituted by the third wall part 113, which is located on the left side in front view of the fifth wall part 115, is referred to as "the left-side surface".

Here, the directions indicated by the arrows X, Y, and Z will be described. The arrow X indicates the direction from the third wall part 113 to the fourth wall part 114. The arrow Y indicates the direction from the sixth wall part 116 to the fifth wall part 115. The arrow Z indicates the direction from the first wall part 111 to the second wall part 112. The direction indicated by the arrow Z coincides with the direction in which an ink supply port (described below) of the cartridge 101 in the protection-cap-equipped cartridge 100 and a sealing part (described below) of the protection cap 102 face each other, and is a subordinate concept of the first direction according to the invention. The direction indicated by the arrow X coincides with the direction from the ink supply port to a plurality of contact parts CP, and is a subordinate concept of the second direction according to the invention. The direction that is parallel with the arrow Y that is orthogonal to the direction indicated by the arrow Z and the direction indicated by the arrow X is a subordinate concept of the third direction according to the invention. In the present description, "above" and "below" regarding the cartridge 101 indicate the top-bottom direction of the cartridge 101 attached to the carriage of the printer with reference to the direction of gravity.

The first wall part 111 is provided with an ink supply part 120 through which ink stored in the cartridge 101 passes while being supplied to the printer (FIGS. 4 and 7). The details of the configuration of the ink supply part 120 will be described later. An outer peripheral wall part 121 is provided along the outer periphery of the ink supply part 120. Within the area that is surrounded by the outer peripheral wall part 121, a communication port 122 is provided on the left-side surface side of the ink supply part 120. The functions of the outer peripheral wall part 121 and the communication port 122 will be described later.

The first wall part 111 is also provided with a positioning part 123 (FIGS. 4 and 7). In the present embodiment, the positioning part 123 is formed as a recessed portion that is recessed in the direction indicated by the arrow Z. A protruding portion that is provided for the carriage is fitted into the positioning part 123 when the cartridge 101 is attached to the carriage of the printer. Consequently, the position and the orientation of the cartridge 101 in the carriage are determined (details of which will be described later). In the present embodiment, the positioning part 123 is provided between the ink supply part 120 and the board part 125 in the direction indicated by the arrow X, at a position that is closer to the board part 125 on the first wall part 111. The positioning part 123 provided close to the board part 125 prevents failure of electrical contact of the board part 125 to an electrode part of the printer from occurring due to positional displacement of the board part 125.

The seventh wall part 117 is provided with the board part 125 (FIGS. 4, 6, and 7). The board part 125 is arranged along the seventh wall part 117, and faces obliquely downward (FIG. 4). The board part 125 has a plurality of terminals 125*t* (FIG. 6). In the present embodiment, two rows, namely an upper row and a lower row, of a plurality of terminals 125*t*, with a predetermined interval therebetween extending in the direction indicated by the arrow Y, are formed in parallel with each other on the board part 125. Each terminal 125*t* is to be electrically connected to the corresponding one terminal of the printer when the cartridge 101 is attached to the carriage of the printer. In the present description, the parts of the board part 125 at which the terminals 125*t* are to be electrically connected to the terminals of the printer are also referred to as "contact parts CP". In other words, the board part 125 has a plurality of contact parts CP.

Figure 8:
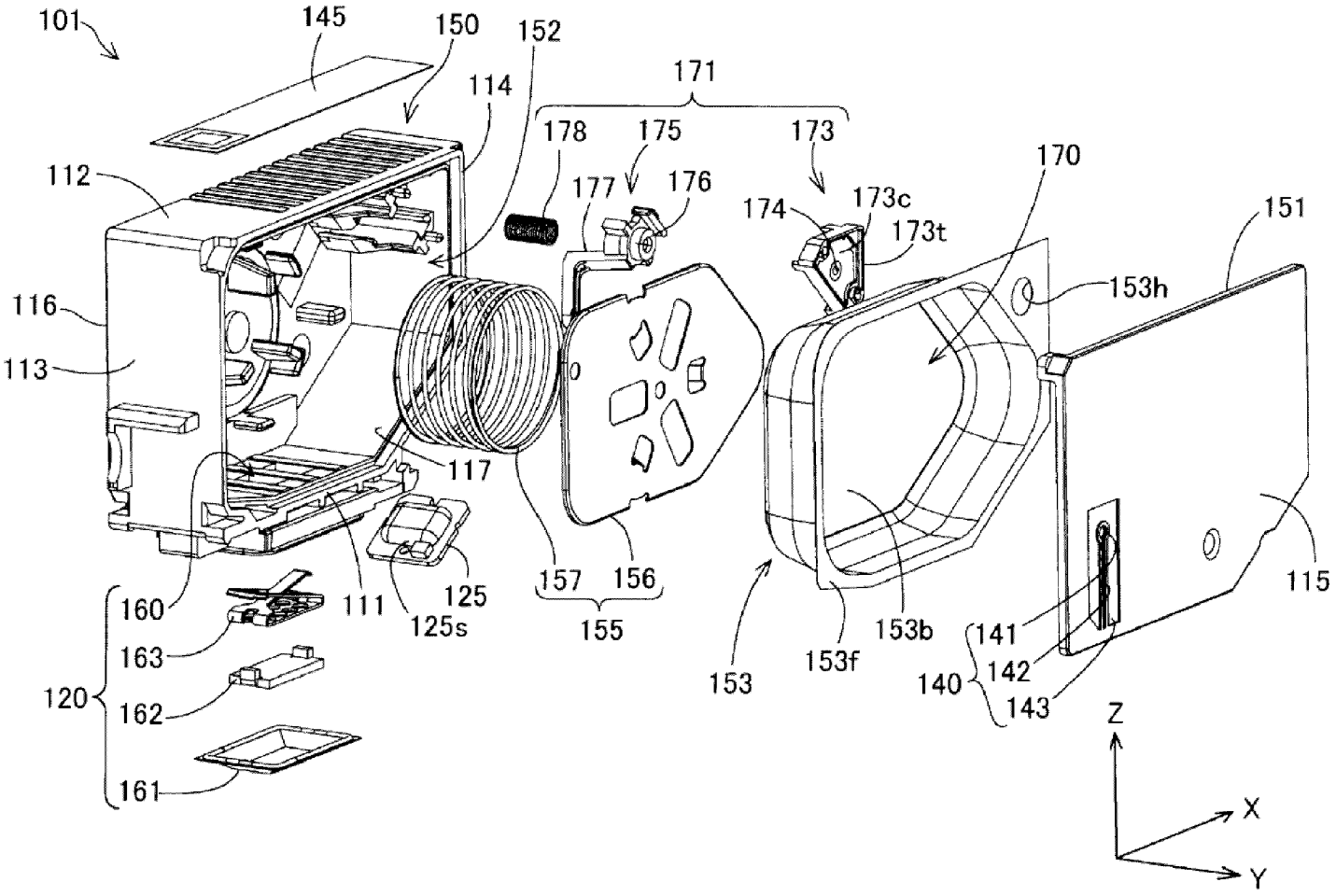
FIG. 8 is a schematic exploded perspective view of the cartridge according to the first embodiment.

The printer transmits and receives electrical signals indicating the attachment state of the cartridge 101 and information regarding ink stored in the cartridge 101 such as the color and the remaining amount via the board part 125. In the present embodiment, information regarding ink is stored in a storage device 125*s* that is provided on the rear surface of the board part 125. The storage device 125*s* is shown in FIG. 8 that will be referred to in the description below.

The cartridge 101 is provided with four engagement-target parts 131 to 134 (FIGS. 3 and 4). The four engagement-target parts 131 to 134 are the parts with which engaging parts (described below) provided on the protection cap 102 engage. In the present description, "engage" means a state in which objects actually engage with each other so as to limit the direction of movement, or, as described in the second embodiment, a state in which objects actually do not engage with each other, but are able to engage with each other. In the cartridge 101 according to the present embodiment, when viewed in the direction indicated by the arrow Z, the four engagement-target parts 131 to 134 are respectively located at the corners of the first wall part 111 (FIG. 7).

In the present embodiment, the first engagement-target part 131 and the second engagement-target part 132 are provided at corners where the first wall part 111 and the seventh wall part 117 intersect each other (FIG. 4). When the cartridge 101 is viewed in the direction opposite the direction indicated by the arrow X, the first engagement-target part 131 and the second engagement-target part 132 are located on the lower side of the board part 125, and are respectively located on both sides of the board part 125 in the direction indicated by the arrow Y (FIG. 6). The first engagement-target part 131 is located on the fifth wall part 115 side, and the second engagement-target part 132 is located on the sixth wall part 116 side.

In the present embodiment, the first engagement-target part 131 and the second engagement-target part 132 are formed as recessed parts that are recessed in the direction opposite the direction indicated by the arrow X and open in the direction indicated by the arrow X. The first engagement-target part 131 is also open in the direction indicated by the arrow Y, and the second engagement-target part 132 is also open in the direction opposite the direction indicated by the arrow Y (FIGS. 4 and 6). The first engagement-target part 131 and the second engagement-target part 132 are orientated in the direction indicated by the arrow Z, and respectively have engagement surfaces 131*s* and 132*s* with which the corresponding engaging parts of the protection cap 102 come into contact.

In the present embodiment, the third engagement-target part 133 and the fourth engagement-target part 134 are provided in the lower end portion of the third wall part 113 (FIG. 3). The third engagement-target part 133 is located at the end on the fifth wall part 115 side, and the fourth engagement-target part 134 is located at the end on the sixth wall part 116 side. In the present embodiment, the third engagement-target part 133 and the fourth engagement-target part 134 are configured as recessed parts that are recessed in the direction indicated by the arrow X and open in the direction opposite the direction indicated by the arrow X. The fourth engagement-target part 134 is also open in the direction opposite the direction indicated by the arrow Y. The third engagement-target part 133 and the fourth engagement-target part 134 are orientated in the direction indicated by the arrow Z, and respectively have engagement surfaces 133*s* and 134*s* with which the corresponding engaging parts of the protection cap 102 come into contact.

The third wall part 113 is provided with a rib part 135 (FIGS. 3 and 5). The rib part 135 protrudes from the wall surface of the third wall part 113 in the direction opposite the direction indicated by the arrow X, and extends along the wall surface of the third wall part 113. In the present embodiment, the rib part 135 has a first portion 135*a* and a second portion 135*b*. The first portion 135*a* is a portion that extends in the direction indicated by the arrow Y, and the second portion 135*b* is a portion that extends from an end portion of the first portion 135*a* on the sixth wall part 116 side in the direction opposite the direction indicated by the arrow Z. The rib part 135 engages with a rib receiving part that is a recessed part provided in the carriage of the printer, and thereby determines the position of the cartridge 101, and functions as a movement restriction part that restricts the movement of the cartridge 101 on the carriage (details of which will be described later). The rib part 135 is a subordinate concept of the fitting part according to the invention, and is also a subordinate concept of the rib of the invention.

The fourth wall part 114 is provided with a fitting part 137 (FIGS. 4 and 6). In the present embodiment, the fitting part 137 protrudes from the wall surface of the fourth wall part 114 in the direction indicated by the arrow X, and is configured as a rib-shaped protruding part that extends along the wall surface of the fourth wall part 114. When viewed in the direction opposite the direction indicated by the arrow X, the shape of the contour of the fitting part 137 corresponds to the shape of a lever (described below) that is provided for the carriage of the printer. When the cartridge 101 is appropriately attached to the carriage, the fitting part 137 fits into and engages with the lever (details of which will be described later). In the present embodiment, the shape of the fitting part 137 of the cartridge 101 and the shape of the lever of the carriage corresponding thereto have been determined for each color of ink in advance. Therefore, it is possible to prevent the cartridge 101 from being mistakenly attached to a position of the carriage that corresponds to a color that does not correspond to the cartridge 101.

The fifth wall part 115 is provided with an air inlet part 140 for introducing air into the inside of the cartridge 101 (FIG. 3). The air inlet part 140 has an air inlet hole 141, an air inlet groove 142, and a peripheral recessed part 143. The air inlet hole 141 is a through hole that is in communication with the inside of the cartridge 101. Air is introduced into the inside of the cartridge 101 via the air inlet hole 141 (details of which will be described later). The air inlet groove 142 is a bottomed groove part that extends substantially straight along the wall surface of the fifth wall part 115. The air inlet groove 142 extends from a position that is in the vicinity of the lower end portion on the first wall part 111 side, in the direction indicated by the arrow Z, and is connected to the air inlet hole 141. The peripheral recessed part 143 is formed by denting a peripheral area around the air inlet hole 141 and the air inlet groove 142 relative to other portions of the fifth wall part 115, in the direction opposite the direction indicated by the arrow Y. Since the peripheral recessed part 143 is formed, the fifth wall part 115 is provided with a rib-shaped protruding wall part 144 that extends along the contours of the air inlet hole 141 and the air inlet groove 142. The functions of the air inlet groove 142 and the peripheral recessed part 143 will be described later.

A seal 145 is attached to the second wall part 112. The seal 145 shows, for example, the manufacturer and the model number of the cartridge 101. The seal 145 may be attached to any position, and the seal 145 may be attached to a wall part other than the second wall part 112. For example, the seal 145 may be attached to one wall part out of the first wall part 111, the third wall part 113, the fourth wall part 114, the fifth wall part 115, the sixth wall part 116, and the seventh wall part 117, or attached so as to span two or more wall parts out of the seven wall parts 111 to 117. Alternatively, a plurality of seals may be attached to a plurality of wall parts.

Internal Configuration of Cartridge

The internal configuration of the cartridge 101 will be described later with reference to FIGS. 8 to 10. FIG. 8 is a schematic exploded perspective view of the cartridge 101. The main body part of the cartridge 101 includes a main body member 150 and a lid member 151. The main body member 150 is a box-shaped member that is open in the direction indicated by the arrow Y. Outer wall parts of the main body member 150 constitute the first wall part 111, the second wall part 112, the third wall part 113, the fourth wall part 114, the sixth wall part 116, and the seventh wall part 117 of the cartridge 101.

The lid member 151 is a plate-shaped member. The lid member 151 is attached so as to close the opening in the main body member 150, and thus constitutes the fifth wall part 115 of the cartridge 101. The main body member 150 and the lid member 151 are formed by injection molding using a synthetic resin such as polypropylene. The above-described board part 125 and the above-described seal 145 are attached to the outer wall surface of the main body member 150. Also, the above-described air inlet part 140 is formed in the lid member 151.

In the cartridge 101, space within a recessed portion of the main body member 150 constitutes an ink container part 152 that stores ink. A portion of the ink container part 152 on the fifth wall part 115 side is closed by a sheet member 153 that is arranged between the main body member 150 and the lid member 151. The sheet member 153 is, for example, constituted by a flexible film-shaped resin member such as a synthetic resin made of a material that contains nylon and polypropylene.

The sheet member 153 includes an outer peripheral part **153*f* and a main body part 153*b*. The outer peripheral part 153*f* is a frame-shaped flat part, and is joined to an opening end of the main body member 150 by welding or adhesive bonding. A through hole 153*h* is formed in the outer peripheral part 153*f*. As described below, the through hole 153*h* allows an air chamber 170 and an air introduction port 174 to be in communication with each other. The main body part 153*b* is a main body of the sheet member 153 that is surrounded by the outer peripheral part 153*f*, and the entirety of the main body part 153*b* protrudes from the outer peripheral part 153*f* toward the sixth wall part 116**, and thus a recessed part that is recessed in the direction opposite the direction indicated by the arrow Y is formed.

The ink container part 152 is provided with a pressure adjustment mechanism 155 that is for maintaining the ink container part 152 in the state of storing ink in a predetermined negative pressure state. The pressure adjustment mechanism 155 is provided with a pressure receiving plate 156 and a biasing member 157. The pressure receiving plate 156 is a flat plate-shaped member that is arranged in the ink container part 152 so as to be in contact with the main body part **153*b* of the sheet member 153. The pressure receiving plate 156 is constituted by synthetic resin such as polypropylene or metal such as stainless steel. The pressure receiving plate 156 has a shape that corresponds to the bottom surface of the recessed portion of the main body part 153*b* of the sheet member 153**, and is joined to the bottom surface.

The biasing member 157 is constituted by, for example, a coil spring. The biasing member 157 is arranged between the pressure receiving plate 156 and the sixth wall part 116, and biases the pressure receiving plate 156 in the direction indicated by the arrow Y in which the inner volume of the ink container part 152 is increased. In the present embodiment, the biasing member 157 biases the pressure receiving plate 156 in the direction indicated by the arrow Y. The pressure receiving plate 156 is pressed by the biasing member 157 toward the fifth wall part 115, the sheet member 153 warps at the outer periphery of the pressure receiving plate 156, and thus the recessed portion of the sheet member 153 is collapsed to the fifth wall part 115 side. Consequently, while the ink container part 152 is filled with ink, the inside of the ink container part 152 is in a predetermined negative pressure state.

The first wall part 111 that constitutes the bottom surface of the ink container part 152 is provided with an opening part 160 for forming the ink supply part 120. The opening part 160 is formed as a through hole that is located at approximately the center of the first wall part 111 and penetrates through the first wall part 111 in the direction indicated by the arrow Z. A filter part 161, a foam part 162, and a leaf spring part 163 are attached to the opening part 160 from below, and thus the ink supply part 120 is constituted.

Figure 9:
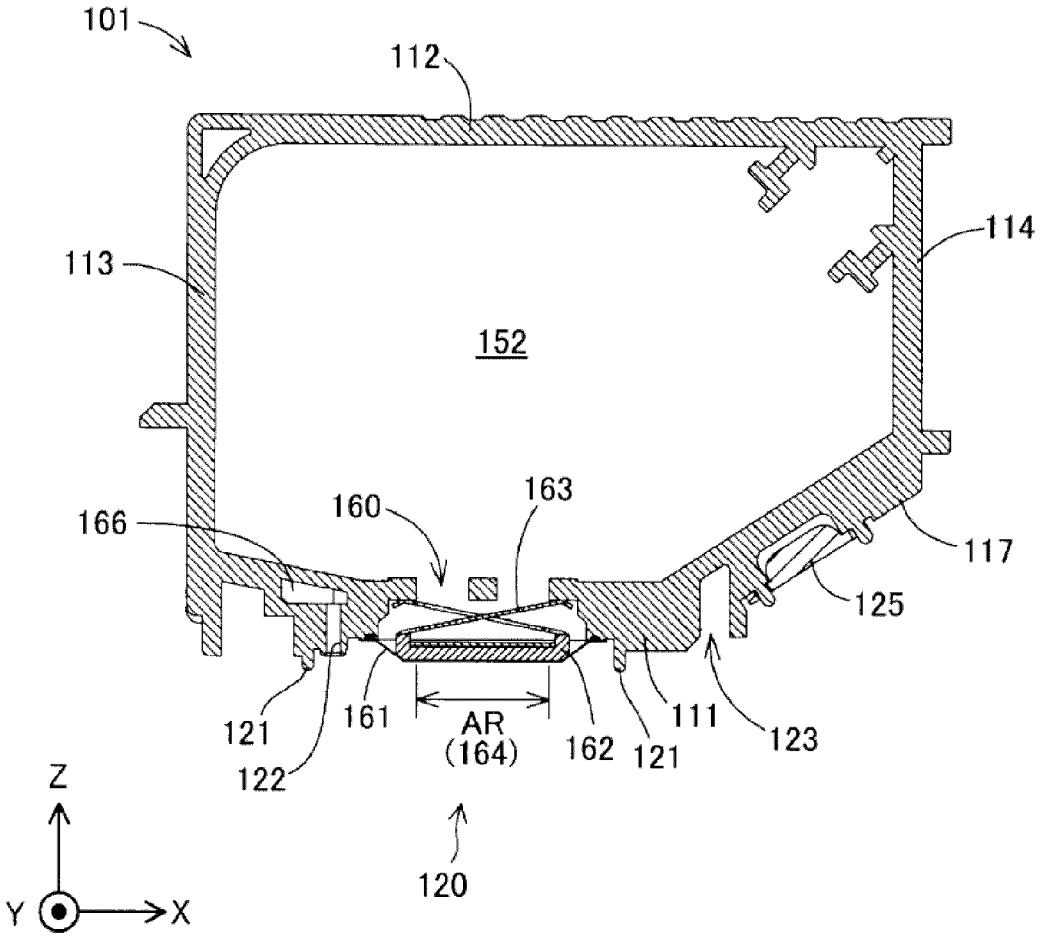
FIG. 9 is a schematic cross-sectional view for illustrating a configuration of an ink supply part according to the first embodiment.
Figure 10A:
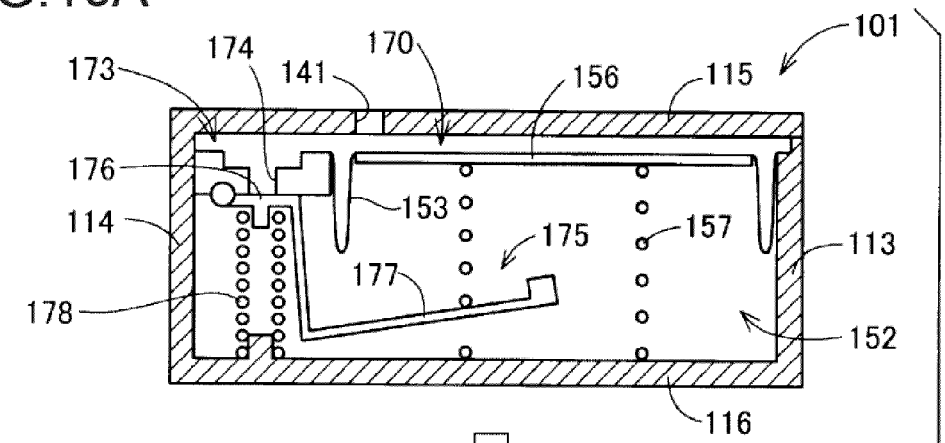
FIGS. 10A-10C are schematic views showing an air intake mechanism in the cartridge according to the first embodiment.
Figure 10B:
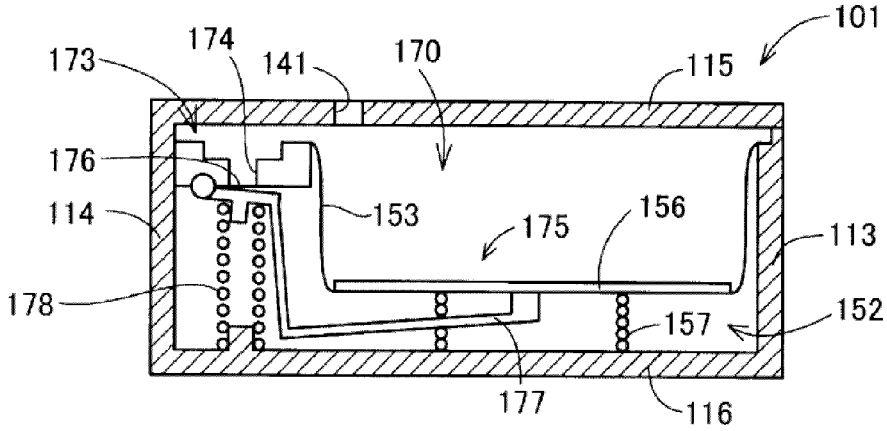
Figure 10C:
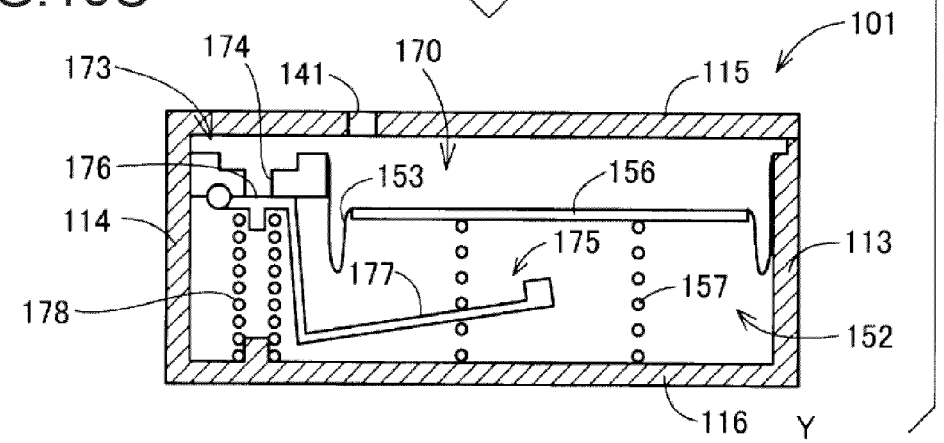
Figure 10C:
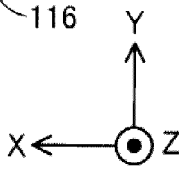

FIG. 9 is a schematic cross-sectional view for illustrating the configuration of the ink supply part 120. FIG. 9 shows a schematic cross section of the cartridge 101 along a line A-A shown in FIG. 5. In FIG. 9, other components in the ink container part 152 are omitted for the sake of convenience. The filter part 161 is arranged so as to cover the opening part 160, and is fused to the peripheral portion of the opening part 160 outside the cartridge 101. The filter part 161 is constituted by a liquid-permeable film-shaped member that allows ink to pass therethrough. The filter part 161 is constituted by, for example, a woven cloth, a non-woven cloth, or a foamable resin (foam).

The foam part 162 is arranged on the surface of the filter part 161 on the ink container part 152 side. The foam part 162 is constituted by a porous member, and is impregnated with ink from the ink container part 152. The foam part 162 supplies ink to the filter part 161 while diffusing ink inside thereof. The foam part 162 is constituted by synthetic resin such as polyethylene terephthalate.

The leaf spring part 163 is constituted by a metal plate, and is arranged between the ink container part 152 and the foam part 162. The leaf spring part 163 has a shape in which two leaf springs intersect each other. The leaf spring part 163 is arranged such that the upper end thereof engages with a step formed on the inner circumferential surface of the opening part 160 and the lower end thereof comes into contact with the foam part 162. Thus the leaf spring part 163 biases the filter part 161 and the foam part 162 in the direction opposite the direction indicated by the arrow Z. The leaf spring part 163 has a shape that does not prevent ink from being distributed from the opening part 160 to the foam part 162.

Here, a contact area AR of the filter part 161 of the ink supply part 120 comes into contact with an ink introduction part (described below) of the carriage when the cartridge 101 is attached to the carriage of the printer. Ink in the ink container part 152 passes through the contact area AR of the filter part 161 and is supplied to the printer. In the present description, the contact area AR through which ink passes is also referred to as "the ink supply port 164". FIG. 7 and FIG. 9 show an example of the area where the ink supply port 164 is formed. The ink supply port 164 is a subordinate concept of the liquid supply port according to the invention.

As described above, the outer peripheral wall part 121 is formed along the outer periphery of the ink supply part 120. When the cartridge 101 is attached to the carriage of the printer, the outer peripheral wall part 121 comes into contact with the sealing part (described below) that is provided for the carriage, and a sealing line is formed around the outer periphery of the ink supply part 120. As described above, the ink supply part 120 and the communication port 122 are formed in the closed space surrounded by the sealing line. The communication port 122 is in communication with the air chamber 170 (FIG. 8) via a communication passage 166 that is formed in the first wall part 111. With this configuration, the difference in pressure between the closed space surrounded by the sealing line and the outside is maintained to be substantially constant while the cartridge 101 is attached to the carriage. Therefore, ink is prevented from leaking from the ink supply part 120 due to changes in the pressure in the closed space.

In the cartridge 101, the space between the sheet member 153 and the fifth wall part 115 functions as the air chamber 170 that stores air (FIG. 8). The external air is introduced into the air chamber 170 via the air inlet hole 141 of the air inlet part 140 provided in the fifth wall part 115. The cartridge 101 is provided with an air valve 171 for introducing air within the air chamber 170 into the ink container part 152 as ink in the ink container part 152 is consumed. The air valve 171 includes a seat 173, a valve member 175, and a coil spring 178.

The seat 173 is arranged at a corner of the ink container part 152 where the second wall part 112 and the fourth wall part 114 intersect each other, so that the seat 173 does not interfere with the pressure receiving plate 156. The seat 173 has a recessed portion 173*c* on the sheet member 153 side, and an opening edge surface 173*t* of the recessed portion 173*c* is adhered airtight to a corner of the outer peripheral part 153*f* of the sheet member 153. The recessed portion 173*c* of the seat 173 is in communication with the through hole 153*h* of the sheet member 153. The air introduction port 174 that penetrates through the seat 173 in the direction indicated by the arrow Y is formed in the bottom of the recessed portion 173*c* of the seat 173. The seat 173 is constituted by, for example, a synthetic resin such as polypropylene.

The valve member 175 includes a disc 176 and a lever 177. The disc 176 is an end part of the valve member 175, and is arranged at a position that faces the air introduction port 174 of the seat 173. The lever 177 is an extension part that extends in a substantially L-like shape from the disc 176. The lever 177 extends from the disc 176 in the direction opposite the direction indicated by the arrow Y, then bends, and extends to a position that faces the pressure receiving plate 156 in the direction indicated by the arrow Y. The valve member 175 is attached such that the lever 177 rotates about a pivot on the disc 176 side. The valve member 175 is constituted by, for example, a synthetic resin such as polypropylene. The valve member 175 may be formed by using two-color molding using an elastic member such as elastomer and a synthetic resin such as polypropylene.

The coil spring 178 is arranged between the disc 176 of the valve member 175 and the sixth wall part 116, and biases the disc 176 so as to press the disc 176 against the air introduction port 174 of the seat 173. By being biased by the coil spring 178, the disc 176 of the valve member 175 comes into contact with the periphery of the air introduction port 174 of the seat 173, and closes the air introduction port 174 airtight.

Mechanism by which External Air is Taken into Cartridge

FIG. 10 is a schematic diagram showing a mechanism by which external air is taken into the cartridge 101. Parts (a) to (c) of FIG. 10 each schematically show an internal configuration of the cartridge 101 viewed along the direction opposite the direction indicated by the arrow Z. In FIG. 10, the ink supply part 120 is omitted for the sake of convenience.

If the ink container part 152 is fully filled with a predetermined amount of ink as described above, the pressure receiving plate 156 is pressed by the biasing member 157 toward the fifth wall part 115, and the inner volume of the ink container part 152 is expanded (Part (a) of FIG. 10). In this state, the pressure receiving plate 156 is located at a position that is the closest to the fifth wall part 115. Also, the inside of the ink container part 152 is in a predetermined negative pressure state, and a portion of the sheet member 153 at the outer periphery of the pressure receiving plate 156 is drawn into the ink container part 152. In addition, in this state, the air introduction port 174 of the seat 173 is closed by the disc 176 of the valve member 175, and the ink container part 152 is sealed airtight from the air chamber 170. The lever 177 of the valve member 175 is located at a position separated from the pressure receiving plate 156.

As Ink is supplied from the ink supply part 120 to the printer via the opening part 160 and ink in the ink container part 152 is consumed, the difference in pressure between the air chamber 170 and the ink container part 152 increases, and the pressure receiving plate 156 moves toward the sixth wall part 116 (Part (b) of FIG. 10). Upon the pressure receiving plate 156 reaching the position at the top end of the lever 177 of the valve member 175 and pressing the lever 177, the valve member 175 rotates and the state in which the air introduction port 174 is sealed by the disc 176 is released. Thus, the air valve 171 enters an open state. Consequently, air in the air chamber 170 is introduced into the ink container part 152, and air outside the cartridge 101 is taken into the air chamber 170 via the air inlet hole 141.

As air is introduced into the ink container part 152 and the difference in pressure between the air chamber 170 and the ink container part 152 decreases, the pressure receiving plate 156 moves toward the fifth wall part 115 due to the biasing force of the biasing member 157 (Part (c) of FIG. 10). Upon the pressure receiving plate 156 being separated from the lever 177 of the valve member 175, the air introduction port 174 is sealed again by the disc 176 due to the biasing force of the coil spring 178, and the air valve 171 returns to an open state again.

As described above, in the cartridge 101, if the negative pressure in the ink container part 152 increases as ink in the ink container part 152 is consumed, the air valve 171 temporarily enters an open state. Then, when the ink container part 152 is in an appropriate negative pressure state as a result of air being introduced into the ink container part 152, the air valve 171 returns to an open state again. Consequently, the pressure in the ink container part 152 is maintained within an appropriate pressure range, and an ink supply failure is prevented from occurring due to negative pressure in the ink container part 152 being too high.

Configuration of Protection Cap

Figure 11:
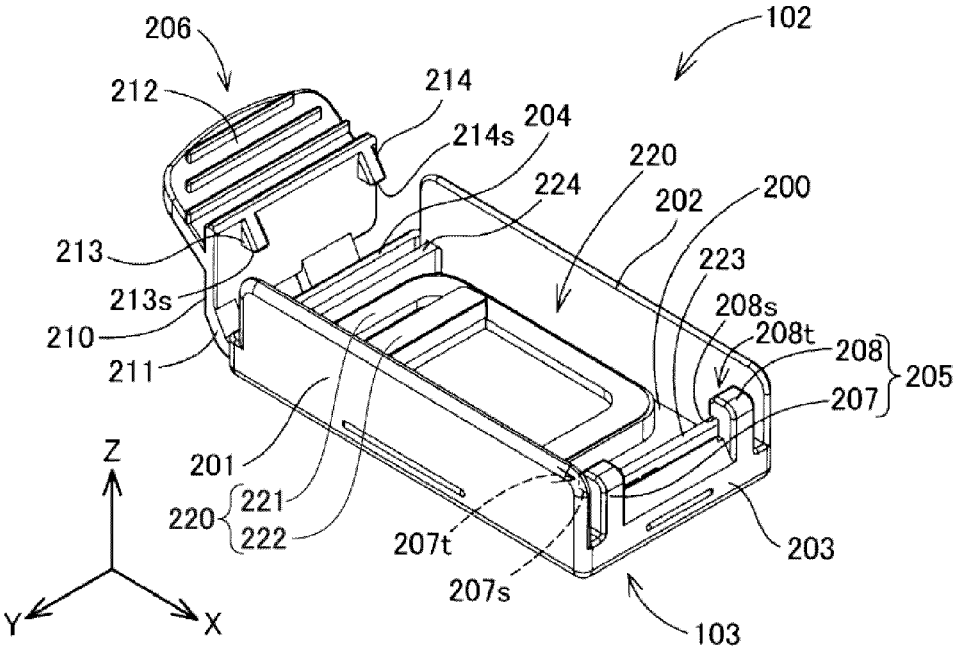
FIG. 11 is a schematic perspective view showing an upper side of the protection cap according to the first embodiment.
Figure 12:
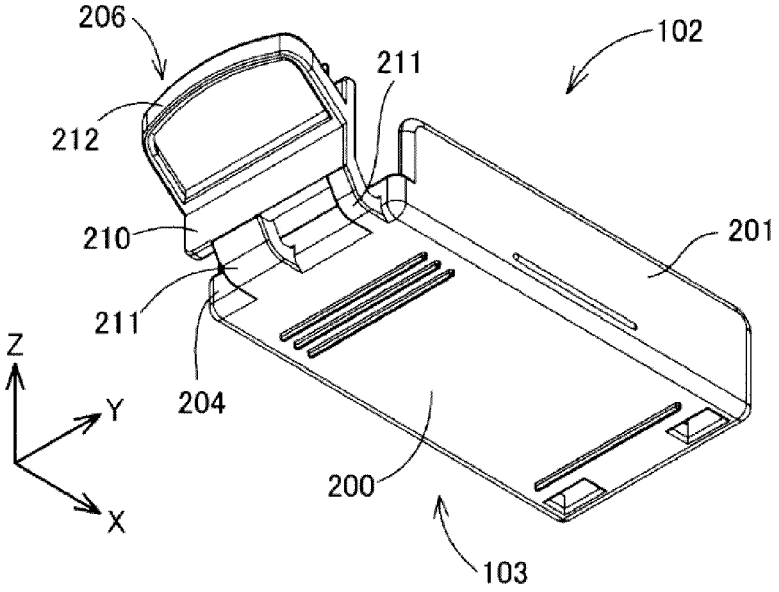
FIG. 12 is a schematic perspective view showing a lower side of the protection cap according to the first embodiment.
Figure 13:
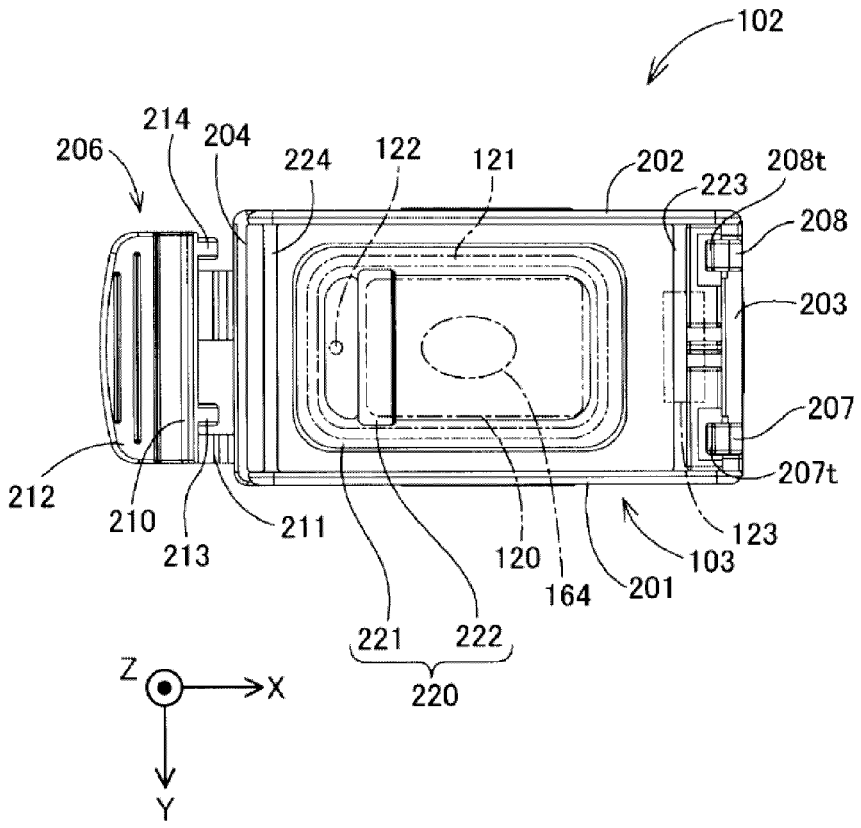
FIG. 13 is a schematic top view of the protection cap according to the first embodiment.
Figure 14:
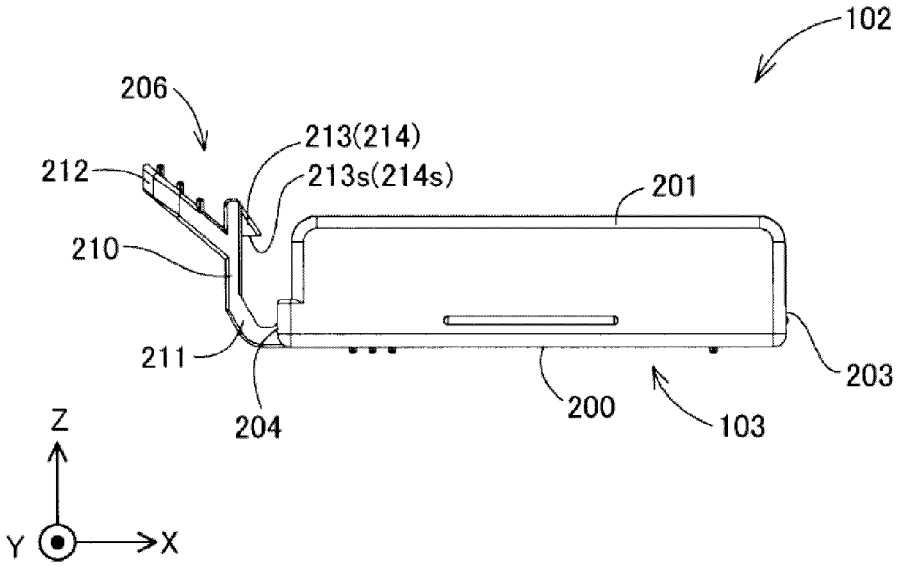
FIG. 14 is a schematic side view of the protection cap according to the first embodiment.

A configuration of the protection cap 102 will be described with reference to FIGS. 11 to 14 and FIGS. 1 and 2. FIG. 11 is a schematic perspective view showing an upper side of the protection cap 102. FIG. 12 is a schematic perspective view showing a lower side of the protection cap 102. FIG. 13 is a schematic top view of the protection cap 102 viewed in the direction that faces the upper surface thereof. FIG. 14 is a schematic side view of the protection cap 102 viewed in the direction that faces a first side wall part 201 thereof. In FIG. 13, for the sake of convenience, the positions of the ink supply part 120, the outer peripheral wall part 121, the communication port 122, and the positioning part 123 when the protection cap 102 has been attached to the cartridge 101 are shown as one-dot chain lines. In FIGS. 11 to 14, the arrows X, Y, and Z with reference to the position of the cartridge 101 to which the protection cap 102 has been attached are shown in correspondence with FIGS. 1 and 2. The "upper surface" of the protection cap 102 means the surface to which the cartridge 101 is attached, and the "lower surface" means the opposite surface.

The protection cap 102 has a base 103 that constitutes a main part that covers almost the entirety of the lower end portion of the cartridge 101 that includes the first wall part 111 (FIG. 1). The base 103 is manufactured by integral molding using injection molding using a synthetic resin such as polypropylene. The base 103 includes a bottom wall part 200, four side wall parts 201, 202, 203, and 204, a board-side engaging part 205, and a lever type engaging part 206 (FIGS. 11 and 12).

The bottom wall part 200 is a plate-like part that has a substantially rectangular shape (FIGS. 12 and 13), and faces the first wall part 111 of the cartridge 101 (FIG. 1). In the protection-cap-equipped cartridge 100, the ink supply part 120 and the positioning part 123 of the cartridge 101 is covered by the bottom wall part 200 (FIG. 13). The bottom wall part 200 is a subordinate concept of the main part according to the invention.

The first side wall part 201 and the second side wall part 202 respectively are wall parts that extend in the direction indicated by the arrow Z from end portions of the bottom wall part 200 that constitute the long sides thereof (FIG. 11). The first side wall part 201 and the second side wall part 202 have approximately the same shape, and extend in parallel with each other in the direction indicated by the arrow Y, spanning approximately the entire length of the long sides of the bottom wall part 200. The first side wall part 201 faces the lower end portion of the fifth wall part 115 of the cartridge 101, and the second side wall part 202 faces the lower end portion of the sixth wall part 116 of the cartridge 101 (FIGS. 1 and 2).

The third side wall part 203 and the fourth side wall part 204 respectively are wall parts that extend in the direction indicated by the arrow Z from end portions of the bottom wall part 200 that constitute the short sides thereof (FIG. 11). The third side wall part 203 is provided at a position that faces the lower end of the seventh wall part 117 of the cartridge 101 in the direction indicated by the arrow Z (FIG. 1). The upper end surface of the fourth side wall part 204 is provided at a position that faces the end portion of the first wall part 111 of the cartridge 101 on the third wall part 113 side, in the direction indicated the arrow Z (FIG. 2). The third side wall part 203 and the fourth side wall part 204 have approximately the same height, and are both lower in height than the first side wall part 201 and the second side wall part 202. The two ends of the third side wall part 203 and the two ends of the fourth side wall part 204 in the direction indicated by the arrow Y are coupled to the lower end portions of the first side wall part 201 and the second side wall part 202.

The board-side engaging part 205 is provided at the upper end of the third side wall part 203 (FIG. 11). When the cartridge 101 is attached to the protection cap 102, the board-side engaging part 205 faces the lower end of the seventh wall part 117 that has the board part 125, in the direction indicated by the arrow Z (FIG. 1).

The board-side engaging part 205 includes a first engaging part 207 and a second engaging part 208 (FIG. 11). The first engaging part 207 and the second engaging part 208 are formed as pillared parts that extend from the upper end of the third side wall part 203 in the direction indicated by the arrow Z. The first engaging part 207 is provided at a position closer to the first side wall part 201, and the second engaging part 208 is provided at a position closer to the second side wall part 202. The engaging parts 207 and 208 respectively extend to approximately the same height as the upper ends of the side wall parts 201 and 202, and claw-like protruding portions 207*t* and 208*t* that extend in the direction opposite the direction indicated by the arrow X are provided at the top ends of the engaging parts 207 and 208. The protruding portions 207*t* and 208*t* respectively have engagement surfaces 207*s* and 208*s* that are flat surfaces that face in the direction opposite the direction indicated by the arrow Z.

When the cartridge 101 is attached to the protection cap 102, the first engaging part 207 engages with the first engagement-target part 131 of the cartridge 101 at the protruding portion 207*t*, and the second engaging part 208 engages with the second engagement-target part 132 at the protruding portion 208*t*. The mechanism by which the engaging parts 207 and 208 and the engagement-target parts 131 and 132 engage with each other will be described later.

The lever type engaging part 206 is provided on the opposite side of the fourth side wall part 204 in the direction indicated by the arrow X (FIG. 11). The lever type engaging part 206 has a protection wall part 210, coupling parts 211, and an operation part 212 (FIG. 12). The protection wall part 210 is a wall part that extend in the two directions indicated by the arrows Y and Z, and faces the lower end portion of the third wall part 113 of the cartridge 101.

The upper end of the wall surface of the protection wall part 210 that faces the cartridge 101 is provided with a third engaging part 213 and a fourth engaging part 214. The third engaging part 213 and the fourth engaging part 214 are formed as protruding parts that extend in the direction indicated by the arrow X from the wall surface of the protection wall part 210, and respectively have engaging surfaces 213*s* and 214*s* that are flat surfaces that face in the direction opposite the direction indicated by the arrow Z. The third engaging part 213 engages with the third engagement-target part 133 of the cartridge 101, and the fourth engaging part 214 engages with the fourth engagement-target part 134. The mechanism by which the engaging parts 213 and 214 and the engagement-target parts 133 and 134 engage with each other will be described later.

The protection wall part 210 is coupled to the bottom wall part 200 with the plurality of coupling parts 211 therebetween (FIG. 14). In the present embodiment, two coupling parts 211, namely a coupling part 211 that has a wider width in the direction indicated by the arrow X, and a coupling part 211 that has a narrower width in the direction indicated by the arrow X, are provided (FIG. 12). The coupling parts 211 extend in the direction opposite the direction indicated by the arrow X from corners between the bottom wall part 200 and the fourth side wall part 204, and then bend and extend in the direction indicated by the arrow Z, and are coupled to the lower end of the protection wall part 210. In the present embodiment, the coupling parts 211 are elastically deformable, and the protection wall part 210 is elastically rotatable in the direction indicated by the arrow Y about the bending portions of the coupling parts 211 serving as a pivot. The protection wall part 210 and the coupling parts 211 are subordinate concepts of the movable part according to the invention.

The operation part 212 is formed as a wall part that extends from the wall surface of the protection wall part 210 in the direction opposite the direction indicated by the arrow X. The operation part 212 is used when the user removes the protection cap 102 from the cartridge 101. The user can remove the protection cap 102 from the cartridge 101 by hooking the operation part 212 with his/her finger and rotating the protection wall part 210 in the direction opposite the direction indicated by the arrow X. The operation part 212 is slightly sloped obliquely upward in the direction opposite the direction indicated by the arrow Y so as to be easy for the user to operate (FIG. 14). The width of the operation part 212 in the direction indicated by the arrow Y is approximately the same as the width of the protection wall part 210 in the direction indicated by the arrow Y, and a protrusion having a rib-like shape and functioning as an anti-slip part is formed on the upper surface, so that the user can easily hook the operation part 212 with his/her finger (FIG. 11).

The recessed part in the upper surface of the bottom wall part 200 surrounded by the four side wall parts 201 to 204 is provided with a sealing part 220 (FIG. 11). The sealing part 220 is softer than the base 103, and is constituted by an elastic resin material. The sealing part 220 is constituted by an elastomer, for example. The sealing part 220 includes a frame part 221 and a partition wall part 222 (FIG. 13).

The frame part 221 has a substantially rectangular shape that corresponds to the shape of the outer peripheral wall part 121 (FIG. 7) that is provided on the first wall part 111 of the cartridge 101. When the cartridge 101 is attached to the protection cap 102, the frame part 221 abuts against the entirety of the upper end surface of the outer peripheral wall part 121, and thus a sealing line is formed along the outer periphery of the ink supply part 120. With this configuration, ink is prevented from leaking to the outside of the protection-cap-equipped cartridge 100.

The partition wall part 222 is a wall part that extends across the frame part 221 in the direction indicated by the arrow X such that the frame part 221 is divided into two regions (FIG. 13). The partition wall part 222 protrudes further in the direction indicated by the arrow Z than the frame part 221 (FIG. 11). When the cartridge 101 is attached to the protection cap 102, the upper end surface of the partition wall part 222 is in contact with and receives the end portion of the ink supply part 120 that is in the direction opposite the direction indicated by the arrow Y. Two end surfaces of the partition wall part 222 in the direction indicated by the arrow Y face the inner circumferential surface of the outer peripheral wall part 121 of the first wall part 111 (FIG. 13).

In the protection-cap-equipped cartridge 100, the partition wall part 222 is fitted to the inner circumferential surface of the outer peripheral wall part 121, and thus functions as a positioning part that determines the position of the cartridge 101 in terms of the direction indicated by the arrow X. Also, in the protection-cap-equipped cartridge 100, the ink supply part 120 is located on the side of the region in the direction indicated by arrow X out of the regions divided by the partition wall part 222 within the frame part 221, and the communication port 122 is located on the side of the region in the direction opposite the arrow X. Therefore, even if ink leaks from the ink supply part 120, the ink is prevented from flowing into the communication port 122 and blocking the communication port 122.

In the present embodiment, two ribs 223 and 224 that protrude in the direction indicated by the arrow Z are provided on the upper wall surface of the bottom wall part 200 in parallel with each other. The first rib 223 is provided between the sealing part 220 and the third side wall part 203 so as to extend in the direction indicated by the arrow X, and is coupled to the first side wall part 201 and the second side wall part 202. The second rib 224 is provided between the sealing part 220 and the fourth side wall part 204 so as to extend in the direction indicated by the arrow X, and is coupled to the first side wall part 201 and the second side wall part 202. The two ribs 223 and 224 both have a height that is approximately the same as the height of the third side wall part 203 and the fourth side wall part 204.

The strength of the base 103 of the protection cap 102 is increased by the two ribs 223 and 224 provided thereon. Also, in the protection-cap-equipped cartridge 100, ink that has leaked to the sealed region of the sealing part 220 is prevented from flowing to the outside by the two ribs 223 and 224. Therefore, ink is further prevented from leaking from the protection-cap-equipped cartridge 100 to the outside.

Process of Attaching Protection Member to Cartridge

Figure 15:
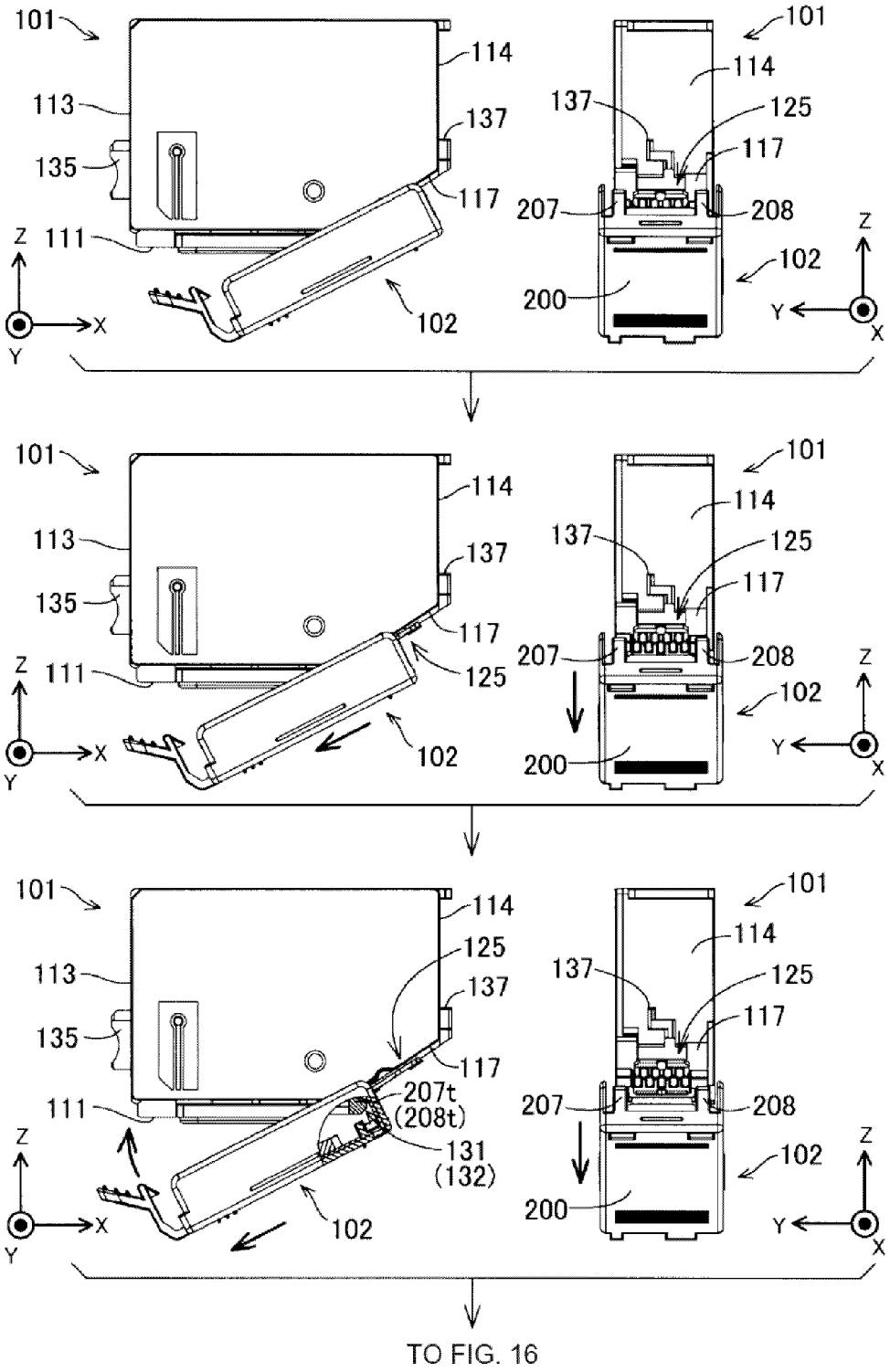
FIG. 15 is a schematic view showing steps of attaching the protection cap according to the first embodiment.
Figure 16:
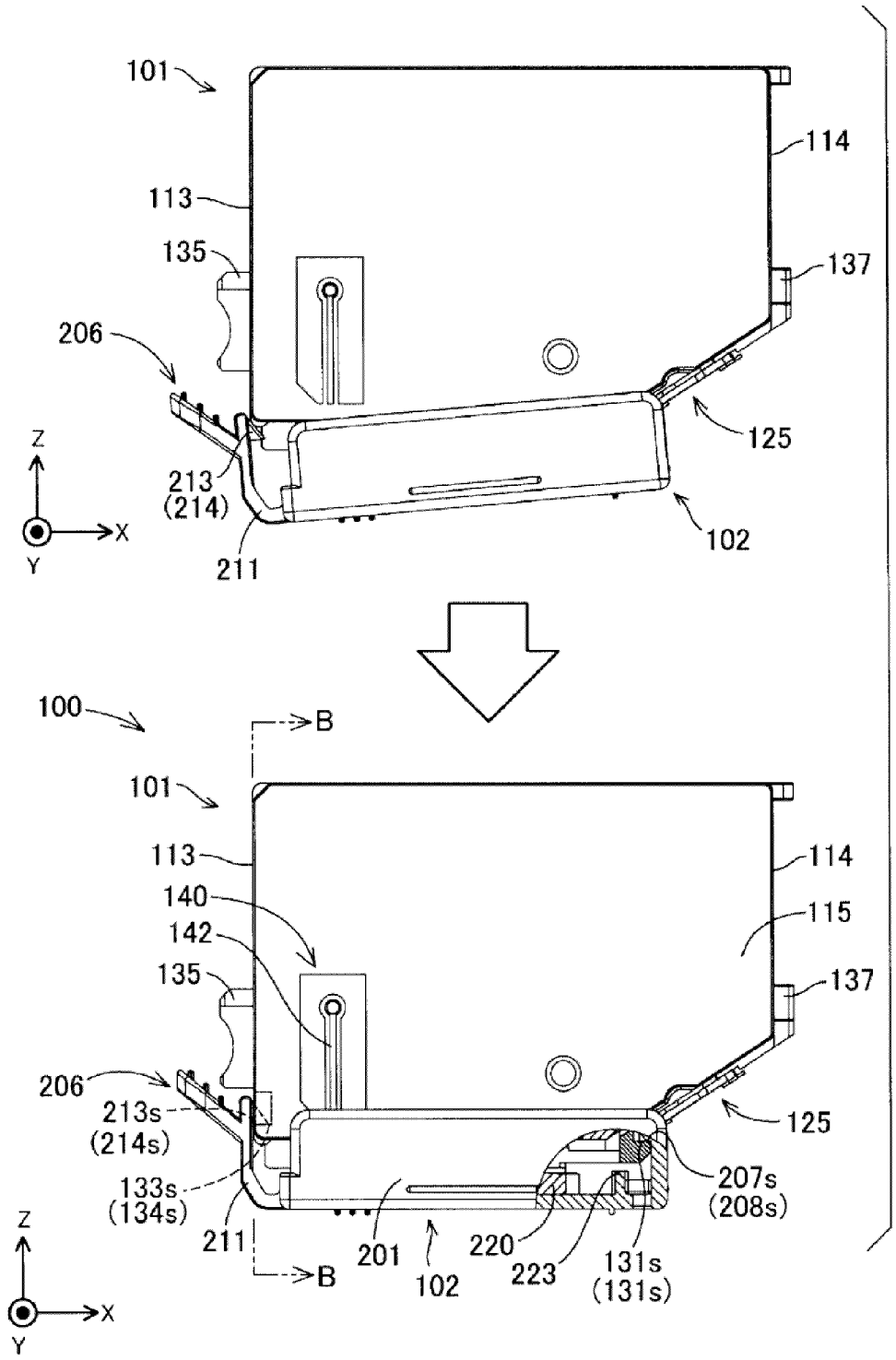
FIG. 16 is a schematic view showing steps of attaching the protection cap according to the first embodiment.

The process of attaching the protection cap 102 to the cartridge 101 will be described with reference to FIGS. 15 to 17. FIGS. 15 and 16 are schematic diagrams showing the process of attaching the protection cap 102 to the cartridge 101 in the sequence of steps. In the first step, the first engaging part 207 and the second engaging part 208 of the board-side engaging part 205 in the protection cap 102 are brought into contact with the wall surface of the seventh wall part 117 of the cartridge 101 (the upper tier in FIG. 15). More specifically, the top ends of the protruding portions 207*t* and 208*t* of the engaging parts 207 and 208 are brought into contact with the wall surface of the seventh wall part 117 at two ends of the board part 125.

In the second step, the top ends of the protruding portions 207*t* and 208*t* of the engaging parts 207 and 208 are slid downward along the wall surface of the seventh wall part 117 while maintaining contact with the wall surface of the seventh wall part 117 (the middle tier in FIG. 15). Consequently, the top end of the protruding portion 207*t* of the first engaging part 207 is fitted into the first engagement-target part 131, the top end of the protruding portion 208*t* of the second engaging part 208 is fitted into the second engagement-target part 132, and thus the protection cap 102 is hooked to the cartridge 101 (the lower tier in FIG. 15). A portion of the lower tier in FIG. 15 is shown in a partial cross-sectional view in order to show that the engaging parts 207 and 208 are fitted into the corresponding engagement-target parts 132 and 133.

As described above, in the cartridge 101 according to the present embodiment, the first engagement-target part 131 is open in the direction indicated by the arrow Y, and the second engagement-target part 132 is open in the direction opposite the direction indicted by the arrow Y. Therefore, even if the protection cap 102 is slightly displaced in the direction indicated by the arrow Y or in the direction opposite the direction indicated by the arrow Y at this stage, the engaging parts 207 and 208 of the protection cap 102 can engage with the corresponding engagement-target parts 131 and 132 of the protection cap 102.

In the third step, the protection cap 102 in this state is rotated upward toward the cartridge 101 about the first engaging part 207 and the second engaging part 208 serving as a pivot. Then, the third engaging part 213 and the fourth engaging part 214 of the protection cap 102 are brought into contact with the lower end of the third wall part 113 (the upper tier in FIG. 16).

In the fourth step, the protection cap 102 is further rotated upward, and thus the protection wall part 210 of the lever type engaging part 206 is rotated in the direction opposite the direction indicated by the arrow X about the coupling parts 211 serving as a pivot. Consequently, the third engaging part 213 and the fourth engaging part 214 first move away from the cartridge 101, run over the wall surface of the third wall part 113, and are then fitted into the third engagement-target part 133 and the fourth engagement-target part 134 of the cartridge 101 (the lower tier in FIG. 16). In this way, the four engaging parts 207, 208, 213, and 214 of the protection cap 102 respectively engage with the engagement-target parts 131, 132, 133, and 134, and thus the protection-cap-equipped cartridge 100 is constituted.

As with the lower tier in FIG. 15, a portion of the lower tier in FIG. 16 is shown in a partial cross-sectional view in order to show that the first engaging part 207 is fitted into the corresponding first engagement-target part 131. In the protection-cap-equipped cartridge 100, the engagement surface 207*s* of the first engaging part 207 faces the engagement surface 131*s* of the first engagement-target part 131 in the direction indicated by the arrow Z, and is in surface contact with the same. The same applies to the engagement surface 208*s* of the second engaging part 208 and the engagement surface 132*s* of the second engagement-target part 132.

Figure 17:
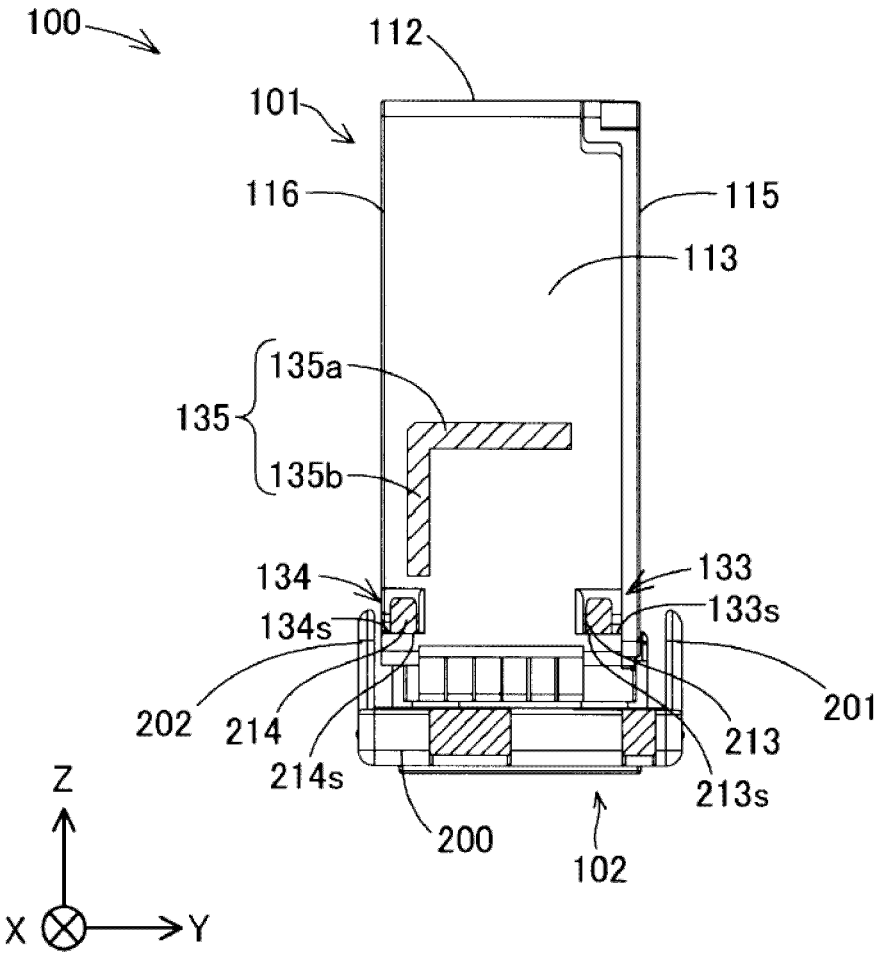
FIG. 17 is a schematic cross-sectional view showing the cartridge provided with the protection cap according to the first embodiment.

FIG. 17 is a schematic cross-sectional view of the protection-cap-equipped cartridge 100 along the line B-B shown in the lower tire in FIG. 16. In the protection-cap-equipped cartridge 100, the engagement surface 213*s* of the third engaging part 213 of the protection cap 102 and the engagement surface 133*s* of the third engagement-target part 133 of the cartridge 101 face each other in the direction indicated by the arrow Z and are in surface contact with each other. The same applies to the engagement surface 214*s* of the fourth engaging part 214 and the engagement surface 134*s* of the fourth engagement-target part 134.

As described above, in the cartridge 101 according to the present embodiment, the fourth engagement-target part 134 is open in the direction opposite the direction indicated by the arrow Y as well. Therefore, in the third step shown in the upper tier in FIG. 16, even if the fourth engaging part 214 of the protection cap 102 is displaced from a predetermined position in the direction opposite the direction indicated by the arrow Y, the fourth engaging part 214 can engage with the fourth engagement-target part 134.

Details of Attachment State of Protection Cap

The protection of the cartridge 101 by each component of the protection cap 102 and the attachability of the protection cap 102 to the cartridge 101 will be described in detail with reference to FIGS. 18 to 21 and the drawings that have been referred to so far.

Figure 18:
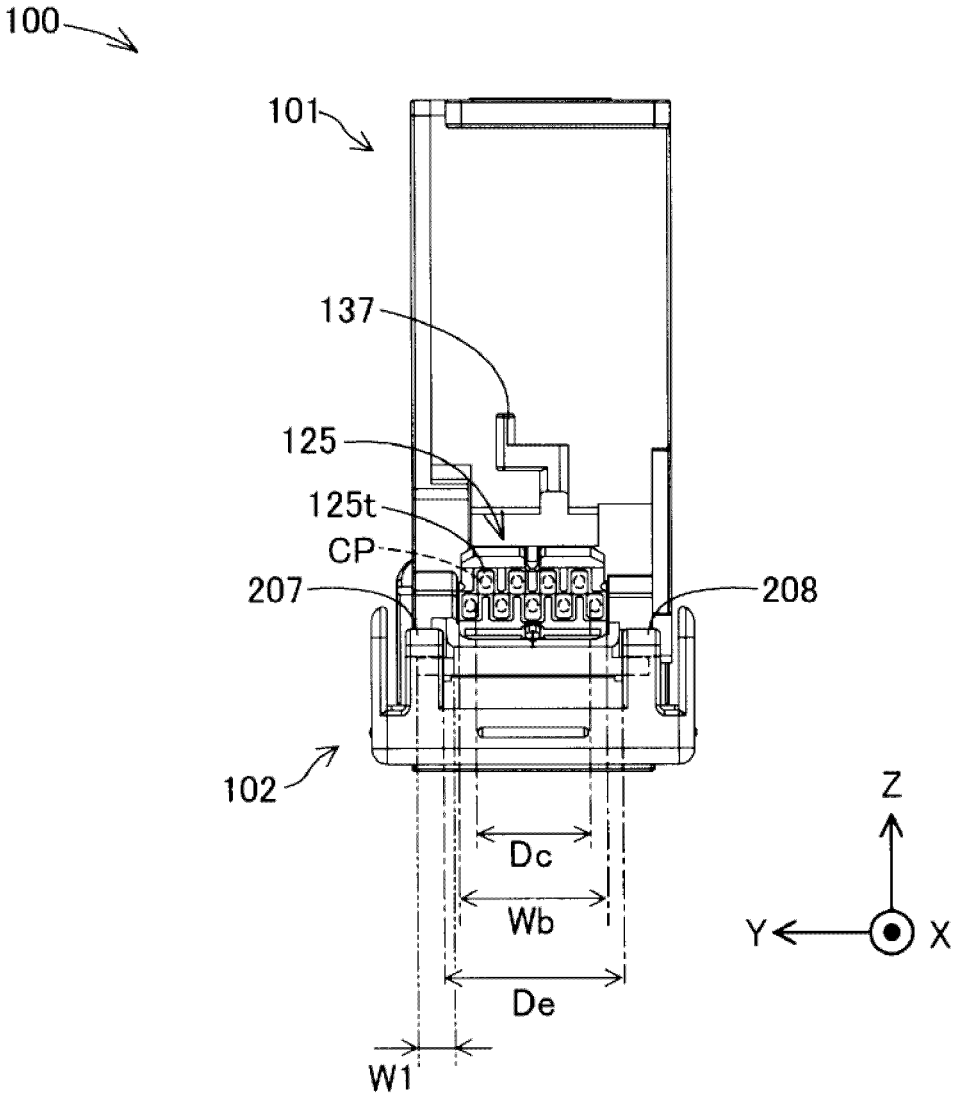
FIG. 18 is a schematic right-side view showing the cartridge provided with the protection cap according to the first embodiment.
Figure 19:
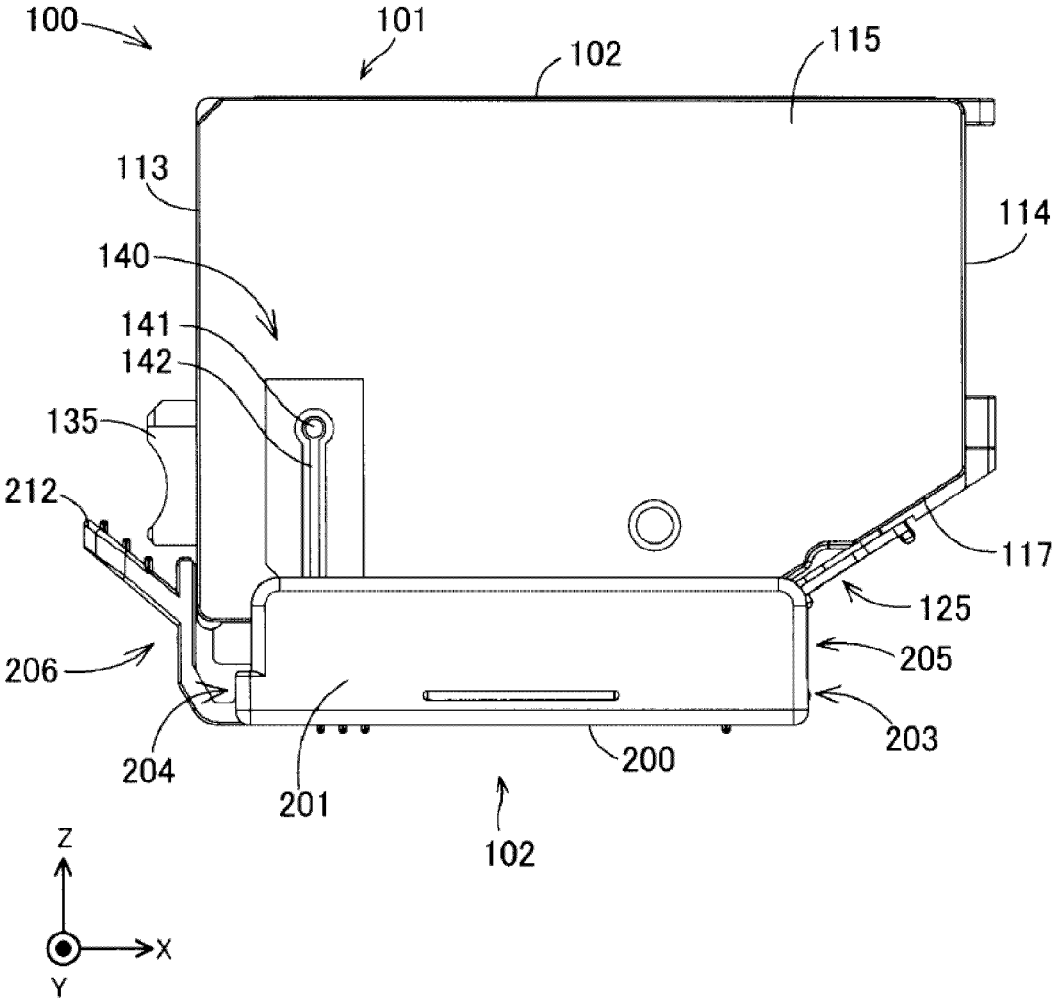
FIG. 19 is a schematic front view showing the cartridge provided with the protection cap according to the first embodiment.

(1) Configurations of First Engaging Part and Second Engaging Part Corresponding to Board Part of Cartridge:

FIG. 18 is a schematic right-side view of the protection-cap-equipped cartridge 100 viewed in the direction facing the fourth wall part 114. FIG. 19 is a schematic front view of the protection-cap-equipped cartridge 100 viewed in the direction facing the fifth wall part 115.

In the protection-cap-equipped cartridge 100 according to the present embodiment viewed in the direction opposite the direction indicated by the arrow X, the board part 125 and the plurality of contact parts CP on the board part 125 are located between the first engaging part 207 and the second engaging part 208 in terms of the direction indicated by the arrow Y (FIG. 18). With this arrangement, the board part 125 and the plurality of contact parts CP are protected by the first engaging part 207 and the second engaging part 208 from both sides in the direction indicated by the arrow Y. Therefore, it is possible to prevent an electrical contact failure from occurring when the cartridge 101 is attached to the carriage of the printer.

Also, in the process of attaching the protection cap 102 (FIG. 15), it is only required that the first engaging part 207 and the second engaging part 208 are arranged so as to sandwich the contact parts CP of the board part 125, it is easier to position the protection cap 102 relative to the cartridge 101. In addition, by sliding the first engaging part 207 and the second engaging part 208 on the wall surface of the seventh wall part 117 along the two end portions of the board part 125 in terms of the direction indicated by the arrow Y, it is possible to smoothly guide the first engaging part 207 and the second engaging part 208 to the corresponding engagement-target parts 131 and 132. Therefore, it is further easier to attach the protection cap 102 to the cartridge 101.

In the protection-cap-equipped cartridge 100 according to the present embodiment, a distance De between the first engaging part 207 and the second engaging part 208 of the protection cap 102 in the direction indicated by the arrow Y is greater than the maximum distance Dc between the plurality of contact parts CP in the direction indicated by the arrow Y (the inequality (A) below).

$$De > Dc \quad (A)$$

Here, "the maximum distance Dc between the plurality of contact parts CP in the direction indicated by the arrow Y" means the distance between the outermost contact parts CP at two ends in the direction indicated by the arrow Y. In the present embodiment, the maximum distance Dc is the distance between the contact parts CP of the terminals 125*t* located at the two ends of the lower row (FIGS. 6 and 18). If the above-described inequality (A) is satisfied, even if the cartridge 101 is slightly displaced in the direction indicated by the arrow X during the process of attaching the protection cap 102, the engaging parts 207 and 208 of the protection cap 102 are prevented from being brought into contact with the plurality of contact parts CP.

In the protection-cap-equipped cartridge 100 according to the present embodiment, the difference between the above-described distance De and the above-described maximum distance Dc is smaller than the width W1 of the first engagement-target part 131 in the direction indicated by the arrow X (the inequality (B) below).

$$De-Dc<W1 \quad (B)$$

Since the relationship expressed by the above-described inequality (B) is satisfied, during the process of attaching the protection cap 102, it is possible to engage the first engaging part 207 with the first engagement-target part 131 by positioning the engaging parts 207 and 208 at positions that are outside the contact parts CP in the direction indicated by the arrow Y. Therefore, the first engaging part 207 and the first engagement-target part 131 can more easily engage with each other.

In the protection-cap-equipped cartridge 100 according to the present embodiment, the following inequalities (A') and (B') in which the maximum distance Dc in the above-described inequalities (A) and (B) is replaced with a width Wb of the board part 125 in the direction indicated by the arrow X are also satisfied.

$$De>Wb \quad (A')$$

$$De-Wb<W1 \quad (B')$$

In the protection-cap-equipped cartridge 100 according to the present embodiment, since the relationship expressed by the above-described inequalities (A') and (B') are satisfied, during the process of attaching the protection cap 102, the engaging parts 207 and 208 are prevented from being brought into contact with the board part 125. Also, during the process of attaching the protection cap 102, it is possible to engage the first engaging part 207 with the first engagement-target part 131 by positioning the engaging parts 207 and 208 at the two ends of the board part 125 in the direction indicated by the arrow Y. Therefore, the first engaging part 207 and the first engagement-target part 131 can even more easily engage with each other.

In addition, in the protection-cap-equipped cartridge 100 according to the present embodiment, the board part 125 and the plurality of contact parts CP on the board part 125 are located at farther corners at which the seventh wall part 117 and the third side wall part 203 of the protection cap 102 intersect each other (FIG. 19). This configuration improves protection for the board part 125 and the plurality of contact parts CP on the board part 125. In particular, in the protection-cap-equipped cartridge 100 according to the present embodiment, the board part 125 is located at the lower end of the seventh wall part 117, which is further closer to the protection cap 102. This configuration further improves protection for the board part 125 and the plurality of contact parts CP on the board part 125.

Figure 20:
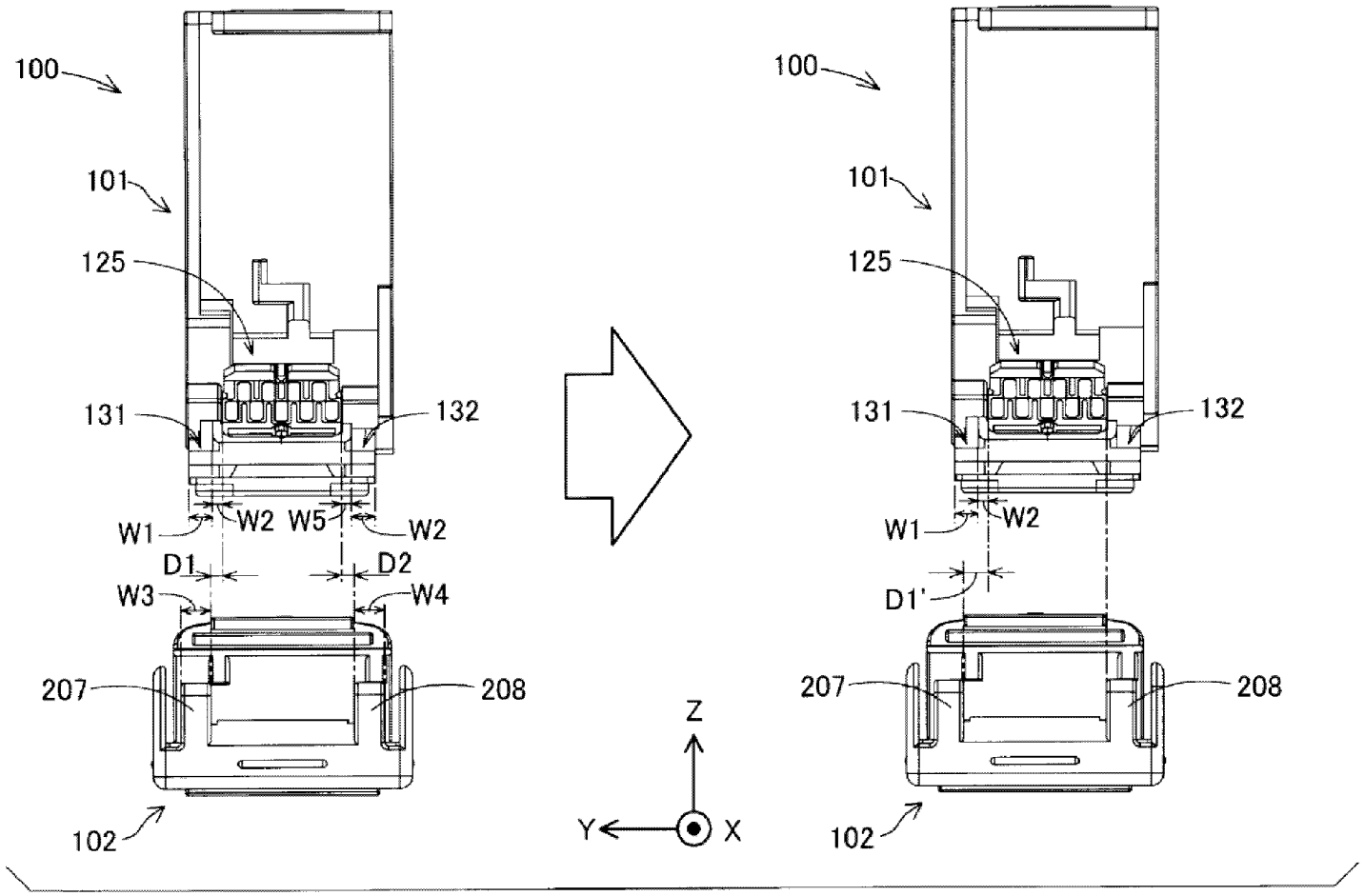
FIG. 20 is a schematic diagram illustrating a first engaging part and a second engaging part according to the first embodiment.

FIG. 20 is a schematic diagram illustrating the respective widths of the first engaging part 207 and the second engaging part 208 of the protection cap 102. The left part of FIG. 20 shows the cartridge 101 and the protection cap 102 in the protection-cap-equipped cartridge 100 are separated from each other in the direction indicated by the arrow Z. In the left part of FIG. 20, the center point between the first engagement-target part 131 and the second engagement-target part 132 of the cartridge 101 in the direction indicated by the arrow Y and the center point between the first engaging part 207 and the second engaging part 208 of the protection cap 102 in the direction indicated by the arrow Y are almost aligned in the direction indicated by the arrow Y. Here, "almost aligned" means that a displacement that is no greater than 1.0 mm is acceptable, for example.

The right part of FIG. 20 shows that the cartridge 101 in the state shown in the left part is offset from the protection cap 102 in the direction indicated by the arrow X. In the right part of FIG. 20, the end portion of the board part 125 on the sixth wall part 116 side is almost aligned in the direction indicated by the arrow Y with the end portion of the second engaging part 208 on the first engaging part 207 side.

In the state shown in the left part of FIG. 20, i.e., in the state where the protection cap 102 has been appropriately attached to the cartridge 101, the separation distance between board part 125 and the first engaging part 207 in the direction indicated by the arrow Y is denoted as D1 and the separation distance between the board part 125 and the second engaging part 208 is denoted as D2. Also, the width of the first engagement-target part 131 of the cartridge 101 in the direction indicated by the arrow Y is denoted as W1, and the minimum distance between the first engagement-target part 131 and the board part 125 in the direction indicated by the arrow Y is denoted as W2. Here, in the protection-cap-equipped cartridge 100 according to the present embodiment, the relationship expressed by the inequality (C) below is satisfied.

$$W2<D1+D2<W1+W2 \quad (C)$$

Here, as shown in the right part of FIG. 20, the separation distance between the board part 125 and the first engaging part 207 in the direction indicated by the arrow Y in the state where the cartridge 101 is displaced from the protection cap 102 in the direction opposite the direction indicated by the arrow Y is denoted as D1'. D1' is obtained by the addition of D1 and D2 shown in the left part of FIG. 20 (D1'=D1+D2). If the relationship expressed by the above-described inequality (C) is satisfied, even if the cartridge 101 is attached to the protection cap 102 in the state of being displaced in the direction opposite the direction indicated by arrow Y as shown in the right part of FIG. 20, the first engaging part 207 can be engaged with the first engagement-target part 131. Thus, the attachability of the protection cap 102 to the cartridge 101 is improved.

In the protection cap 102, the width of the first engaging part 207 in the direction indicated by the arrow Y is denoted as W3. Here, in the protection-cap-equipped cartridge 100 according to the present embodiment, the relationship expressed by the inequality (D) below is satisfied.

$$W3>W2 \quad (D)$$

If the relationship expressed by the above-described inequality (D) is satisfied, when the protection cap 102 is to be attached to the cartridge 101, the first engaging part 207 is prevented from passing between the board part 125 and the first engagement-target part 131 without engaging with the first engagement-target part 131.

Furthermore, in the protection cap 102, the width of the second engaging part 208 in the direction indicated by the arrow Y is denoted as W4, and in the cartridge 101, the distance between the board part 125 and the second engagement-target part 132 in the direction indicated by the arrow Y is denoted as W5. Here, in the protection-cap-equipped cartridge 100 according to the present embodiment, the relationship expressed by the inequality (E) below is satisfied.

$$W4>W5 \quad (E)$$

If the relationship expressed by the above-described inequality (E) is satisfied, when the protection cap 102 is to be attached to the cartridge 101, the second engaging part 208 is prevented from passing between the board part 125 and the second engagement-target part 132 without engaging with the second engagement-target part 132.

As described above, in the protection-cap-equipped cartridge 100 according to the present embodiment, the contact parts CP are protected due to the presence of the first engaging part 207 and the second engaging part 208. Also, the positioning of the first engaging part 207 and the second engaging part 208 and the engagement thereof with the corresponding engagement-target parts 131 and 132 during the process of attaching the protection cap 102 to the cartridge 101 is easier, and the attachability of the protection cap 102 to the cartridge 101 is improved.

(2) Configuration of Four Engaging Parts for Positioning Part:

As can be understood from FIG. 13, in the protection-cap-equipped cartridge 100 according to the present embodiment viewed in the direction indicated by the arrow Z, the positioning part 123 provided on the first wall part 111 is covered by the bottom wall part 200 of the protection cap 102. Therefore, foreign objects such as dust are prevented from entering the positioning part 123 before the cartridge 101 is attached to the carriage of the printer, and it is possible to prevent the attachability of the cartridge 101 to the carriage from being degraded.

(3) Arrangement of Third Engaging Part and Fourth Engaging Part:

As shown in FIG. 17, in the protection-cap-equipped cartridge 100 according to the present embodiment viewed in the direction indicated by the arrow X, the rib part 135 is located between the third engaging part 213 and the fourth engaging part 214 of the protection cap 102 in terms of the direction indicated by the arrow Y. When the protection cap 102 is to be attached to the cartridge 101, the protection cap 102 is to be positioned relative to the cartridge 101 such that the third engaging part 213 and the fourth engaging part 214 are located at the two ends of the rib part 135 of the cartridge 101. In other words, in the protection-cap-equipped cartridge 100, when the protection cap 102 is to be attached to the cartridge 101, the positions of the third engaging part 213 and the fourth engaging part 214 of the protection cap 102 can be determined relative to the rib part 135. Therefore, it is easier to attach the protection cap 102 to the cartridge 101.

Also, as described above, when the protection cap 102 is to be attached to the cartridge 101, the third engaging part 213 and the fourth engaging part 214 are brought into contact with the lower end of the third wall part 113 of the cartridge 101 before being engaged with the engagement-target parts 133 and 134 corresponding thereto (the upper tier in FIG. 16). As described above, in the protection-cap-equipped cartridge 100, the third engaging part 213 and the fourth engaging part 214 also serve as guides for appropriately attaching the protection cap 102 to the cartridge 101. Therefore, convenience when the protection cap 102 is attached to the cartridge 101 is improved.

(4) Arrangement of Four Engaging Parts:

As shown in FIG. 13, in the protection-cap-equipped cartridge 100 according to the present embodiment, the ink supply part 120 that includes the ink supply port 164 is located at a position that is surrounded by the four engaging parts 207, 208, 213, and 214 when viewed in the direction indicated by the arrow Z. With this configuration, in the protection-cap-equipped cartridge 100, the position of the sealing part 220 relative to the ink supply part 120 is more stable. Therefore, the sealability of the sealing part 220 with respect to the ink supply part 120 is improved, the sealing part 220 is prevented from becoming separated from the ink supply part 120, and ink is prevented from leaking from the ink supply part 120 of the cartridge 101.

Also, in the protection-cap-equipped cartridge 100 according to the present embodiment, the four engaging parts 207, 208, 213, and 214 are located at the lower end of the third wall part 113 or the seventh wall part 117, and they are at almost the same height as the sealing part 220. Therefore, the position of the sealing part 220 relative to the ink supply part 120 is more stable.

In addition, in the protection-cap-equipped cartridge 100 according to the present embodiment, the four engaging parts 207, 208, 213, and 214 are respectively provided at the four corners of the first wall part 111 of the cartridge 101 in one-to-one correspondence. Therefore, the protection cap 102 is attached to the cartridge 101 in a balanced manner, and the protection cap 102 is prevented from unexpectedly falling off the cartridge 101.

(5) Improvement in Packaging Performance of Cartridge by Using Protection Cap:

As shown in FIG. 19, in the protection-cap-equipped cartridge 100 according to the present embodiment viewed in the direction indicated by the arrow X, the lower end of the air inlet groove 142 that the air inlet part 140 of the cartridge 101 has overlaps the first side wall part 201 of the protection cap 102. With this configuration, as described below, it is possible to set the pressure in the cartridge 101 to be in an appropriate negative state when the protection-cap-equipped cartridge 100 is shipped from the factory.

Figure 21:
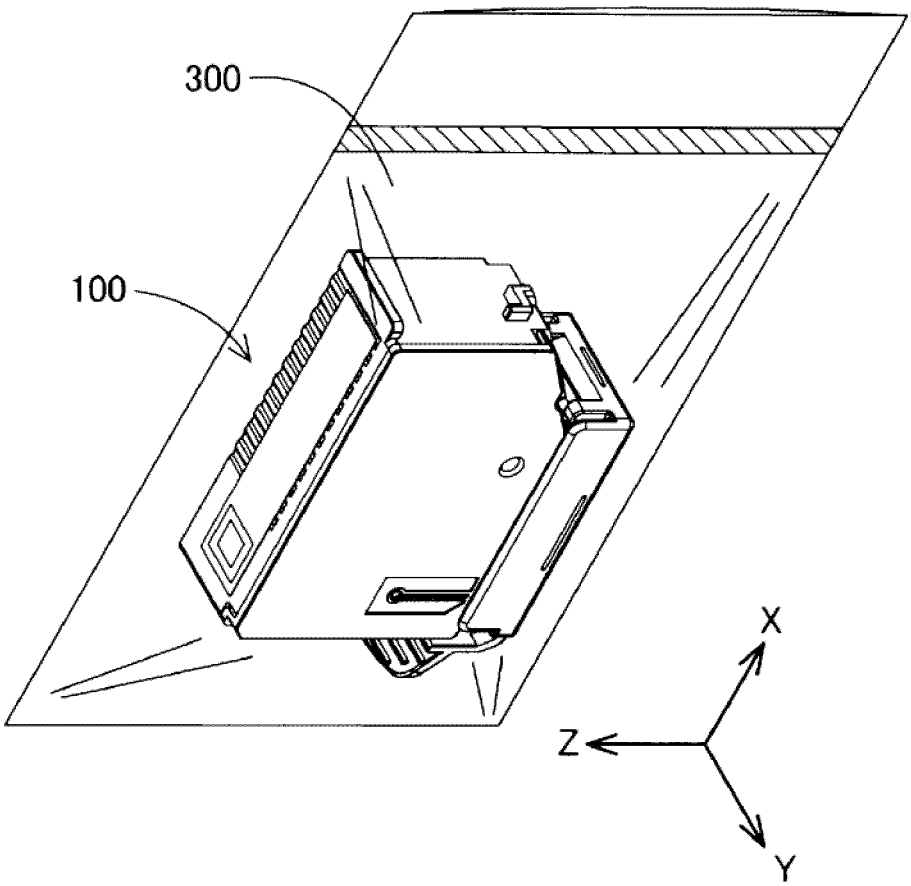
FIG. 21 is a schematic view showing an example of the state of the cartridge provided with the protection cap according to the first embodiment at the time of shipment from a factory.

FIG. 21 is a schematic diagram showing an example of the state of the protection-cap-equipped cartridge 100 when shipped from the factory. In some cases, the protection-cap-equipped cartridge 100 is enclosed in a bag-like packaging member 300 constituted by a sheet-like flexible resin member (e.g. polyethylene or polyvinyl chloride), when the protection-cap-equipped cartridge 100 is shipped from the factory. With the protection-cap-equipped cartridge 100 according to the present embodiment, by sucking out air in the packaging member 300 in the state of being enclosed in the packaging member 300, it is possible to suck out air in the cartridge 101 as well via the air inlet part 140. Therefore, it is possible to effectively set the pressure in the packaging member 300 and the cartridge 101 to be in a desired negative pressure state.

In the protection-cap-equipped cartridge 100 according to the present embodiment, as described above, a portion of the air inlet part 140 is located at a position that overlaps the first side wall part 201 of the protection cap 102 in the direction indicated by the arrow X. With this configuration, when the packaging member 300 has a negative pressure as described above, a portion of the packaging member 300 that is flexible is prevented from being brought into intimate contact with the air inlet part 140 and sealing the air inlet part 140 by the first side wall part 201 of the protection cap 102 that has a relatively low flexibility. Therefore, the air inlet part 140 is prevented from being sealed by the packaging member 300 before the cartridge 101 has reached a desired negative pressure state, and it is possible to more reliably set the pressure in the cartridge 101 to be in an appropriate negative pressure state.

In particular, in the protection-cap-equipped cartridge 100 according to the present embodiment, the fifth wall part 115 of the cartridge 101 and the first side wall part 201 of the protection cap 102 are separated from each other. Even if the first side wall part 201 falls over and comes into contact with the fifth wall part 115, a gap is secured between the first side wall part 201 and the fifth wall part 115 by the peripheral recessed part 143. Therefore, the air inlet part 140 is further prevented from being sealed by the packaging member 300.

Attachment of Cartridge to Printer

Figure 22:
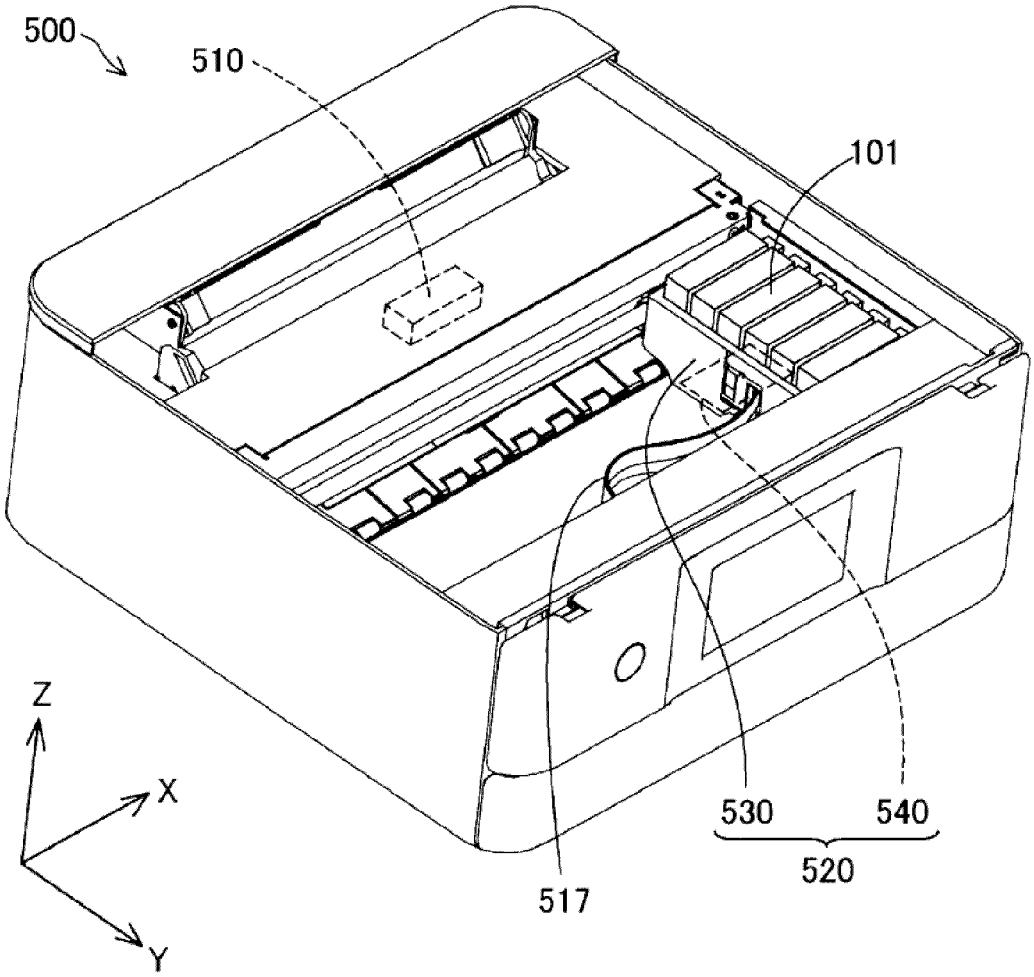
FIG. 22 is a schematic perspective view showing a configuration of a printer according to the first embodiment.

With reference to FIGS. 22 to 26, an example of the configuration of a printer 500 to which the cartridge 101 is to be attached will be described first, and furthermore attachment of the cartridge 101 to the printer 500 will be described. FIGS. 22 to 26 show the arrows X, Y, and Z that indicate directions corresponding to the above-described directions with reference to the position of the cartridge 101 in the attached state. FIG. 22 is a schematic perspective view of the printer 500. The cartridge 101 is detachably attached to the printer 500 by the user. The printer 500 is a subordinate concept of the liquid ejection apparatus.

The printer 500 is provided with a control unit 510 and a carriage 520. The control unit 510 is constituted by a microcomputer that has a central processing unit and a main memory. The control unit 510 loads various instructions and programs to the main memory and executes them to control the components of the printer 500 and perform printing processing and so on.

The carriage 520 is provided with a holder part 530 and a printing head part 540. The holder part 530 is configured such that a plurality of cartridges 101 are attachable thereto in parallel. In the present embodiment, the cartridges 101 are attached to the holder part 530, in the state of being arranged in a row along the direction indicated by the arrow Y. The details of the configuration of the holder part 530 will be described later.

The printing head part 540 is provided on the lower surface of the holder part 530. The printing head part 540 receives ink supplied from the cartridge 101 attached to the holder part 530. The printing head part 540 is provided with an ink chamber for storing ink and a nozzle provided for the ink chamber. The printing head part 540 discharges ink in the ink chamber from the nozzle based on a control signal from the control unit 510 by using a well-known method such as application of pressure to ink using a piezoelectric element.

The printer 500 is provided with a carriage drive mechanism (not shown) for linearly moving the carriage 520 back and forth. The carriage drive mechanism is provided with a rail along which the carriage 520 moves, a motor that generates a driving force, and a pulley that transmits the driving force. The carriage drive mechanism moves the carriage 520 back and forth below the control of the control unit 510. The direction along which the carriage 520 moves back and forth is the horizontal scanning direction. In the present embodiment, the horizontal scanning direction is the direction that is parallel with the direction indicated by the arrow X.

The control unit 510 and the carriage 520 are electrically connected with each other via a flexible cable 517. The control unit 510 exchanges signals indicating, for example, information regarding ink and the attachment state of the cartridge 101, with the board part 125 of the cartridge 101 via the flexible cable 517. Also, the control unit 510 transmits a control signal for controlling discharge of ink, to the printing head part 540 via the flexible cable 517.

The printer 500 is also provided with a conveyance mechanism (not shown) for conveying printing media. The conveyance mechanism is provided with a conveyance motor and a conveyance roller, and drives under the control of the control unit 510. In the printer 500, printing media are conveyed by the conveyance mechanism, in the direction that is almost orthogonal to the horizontal scanning direction, below the conveyance path of the carriage 520. The direction in which printing media are conveyed is the vertical scanning direction. In this embodiment, the vertical scanning direction is the direction indicated by the arrow Y.

Figure 23:
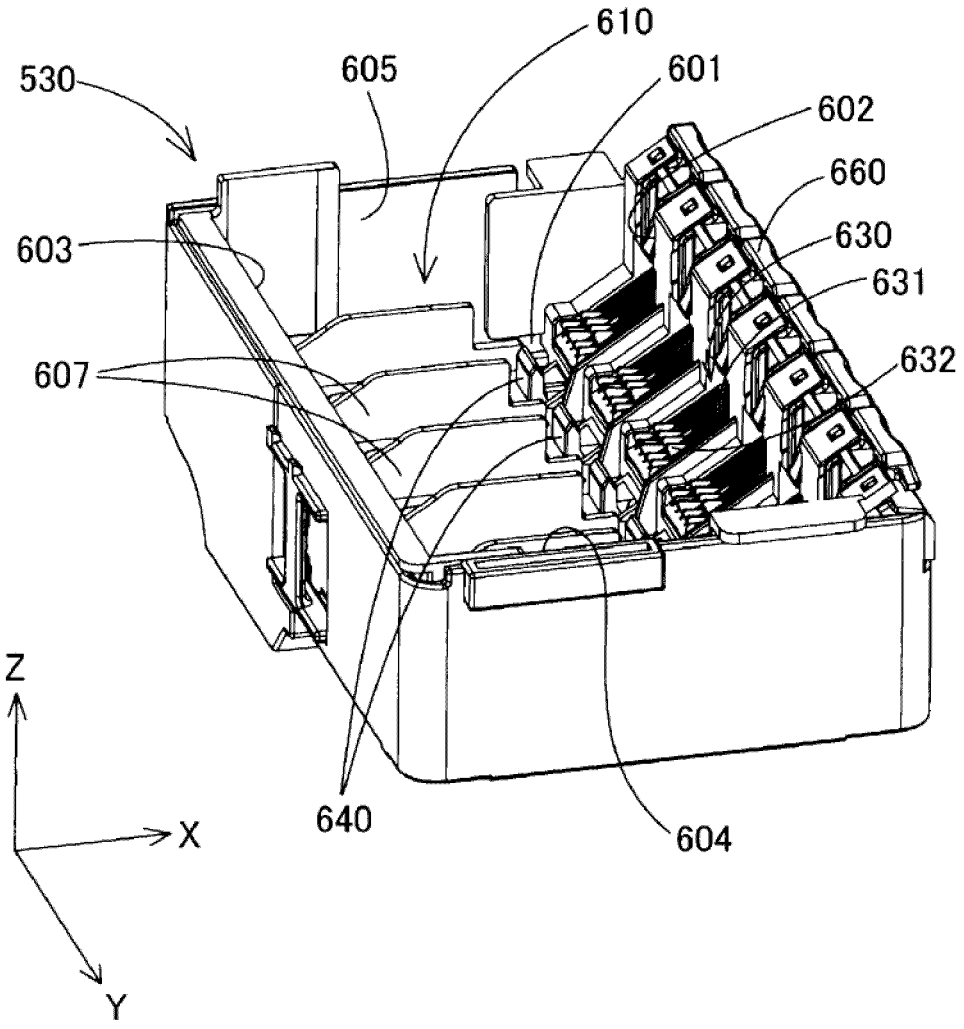
FIG. 23 is a schematic perspective view showing a configuration of a holder part that a carriage has according to the first embodiment.
Figure 24:
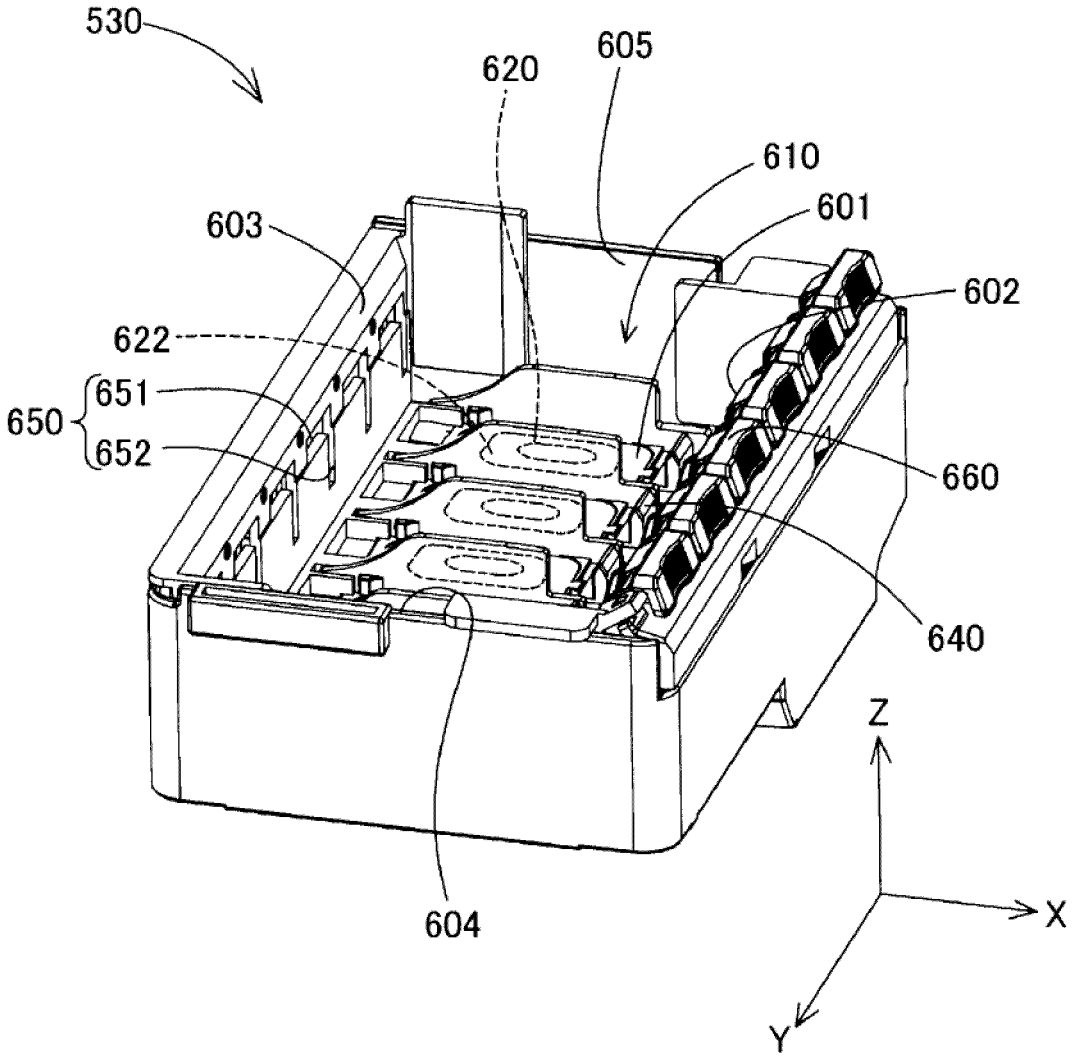
FIG. 24 is a schematic perspective view showing the holder part according to the first embodiment.
Figure 25:
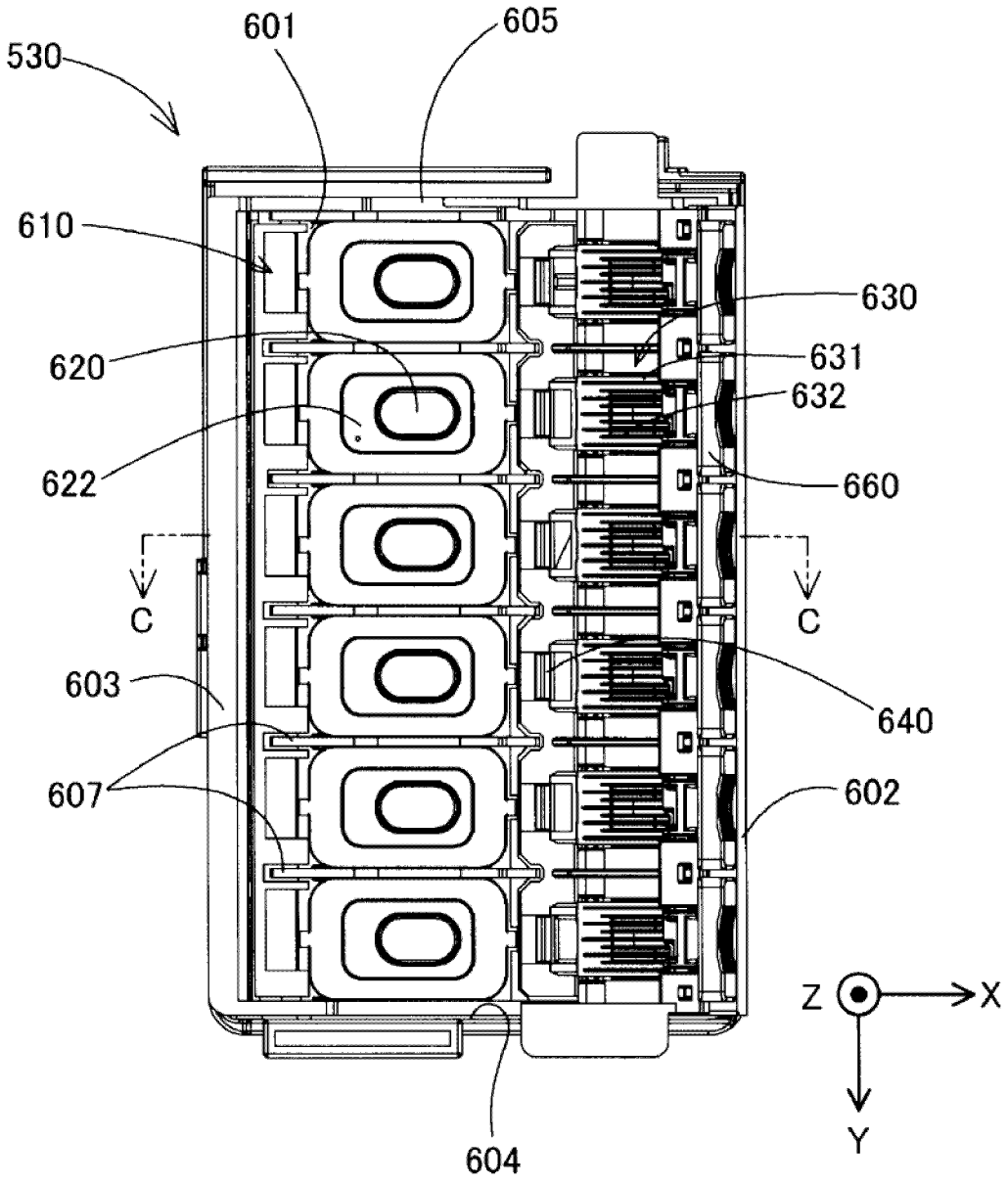
FIG. 25 is a schematic plan view showing the holder part according to the first embodiment.
Figure 26:
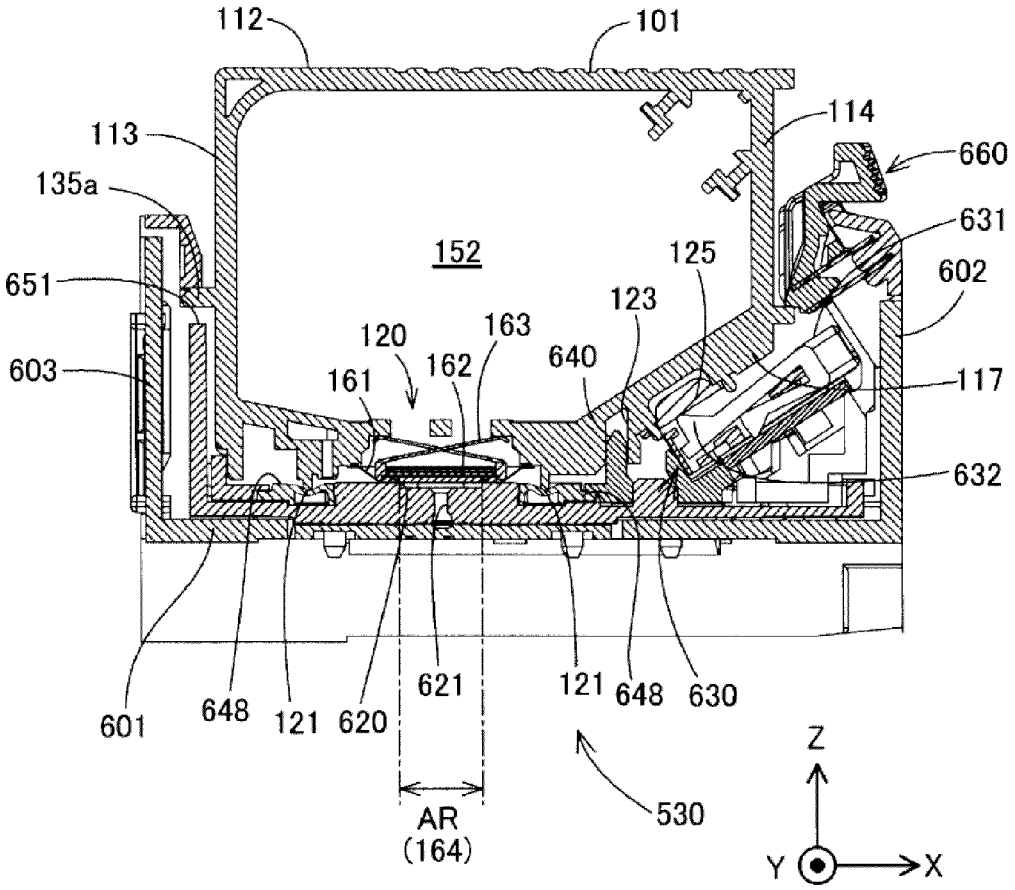
FIG. 26 is a schematic cross-sectional view showing the holder part according to the first embodiment.

FIGS. 23 and 24 are schematic perspective views showing a configuration of the holder part 530 of the carriage 520. FIG. 25 is a schematic plan view when the holder part 530 is viewed downward from above. FIG. 26 is a schematic cross-sectional view of the holder part 530 along the line C-C in FIG. 25. FIG. 26 shows the holder part 530 to which cartridges 101 have been attached. In the present embodiment shown in FIG. 26, cartridges 101 of six types that each store ink of a different color are individually attached to the holder part 530. More specifically, six cartridges 101 that respectively store ink of six colors, namely black, yellow, magenta, light magenta, cyan, and light cyan, are attached.

The holder part 530 is configured as a substantially rectangular box that is open in the direction indicated by the arrow Z, and has five wall parts 601, 602, 603, 604, and 605 (FIGS. 23 to 25). The first wall part 601 faces in the direction indicated by the arrow Z, extends in the two directions indicated by the arrows X and Y, and constitutes the bottom surface of the holder part 530. In the following description, the first wall part 601 is also referred to as the bottom wall part 601.

The other four wall parts 602 to 605 intersect the bottom wall part 601, extend in the direction indicated by the arrow Z from the bottom wall part 601, and thus respectively constitute side faces of the holder part 530. In the holder part 530, a cartridge housing part 610 to which the cartridges 101 are to be attached is constituted by a recessed part that is surrounded by these five wall parts 601 to 605.

The second wall part 602 faces the fourth wall parts 114 and the seventh wall parts 117 of the cartridges 101. The third wall part 603 is located at a position that faces the second wall part 602 in the direction indicated by the arrow X, and faces the third wall parts 113 of the cartridges 101. The fourth wall part 604 intersects the second wall part 602 and the third wall part 603, and faces the fifth wall parts 115 of the cartridges 101. The fifth wall part 605 intersects the second wall part 602 and the third wall part 603, is located at a position that faces the fourth wall part 604 in the direction indicated by the arrow Y, and faces the sixth wall parts 116 of the cartridges 101.

The cartridge housing part 610 is divided by a plurality of partition walls 607 that are parallel with the fourth wall part 604 and the fifth wall part 605, into a plurality of areas (slots) that can respectively receive the cartridges 101. The partition walls 607 serve as guides for inserting the cartridges 101 into the slots. The slots are open in the direction indicated by the arrow Z, and the cartridges 101 are inserted in the direction opposite the direction indicated by the arrow Z. Each slot is provided with an ink introduction part 620, an electrode part 630, a protruding part 640, a rib receiving part 650, and a lever 660.

The ink introduction part 620 is configured as a substantially elliptical opening part that opens in the direction indicated by the arrow Z (FIG. 24). The ink introduction part 620 is provided at a position between two adjacent partition walls 607. When a cartridge 101 has been attached to the holder part 530, the ink introduction part 620 is in contact with the filter part 161 of the ink supply part 120 (FIG. 26). Ink in the cartridge 101 flows into a flow channel 621 that is formed in the holder part 530, via the ink introduction part 620, and is supplied to the ink chamber (not shown) of the printing head part 540.

A sealing part 622 is provided so as to surround the ink introduction part 620 (FIGS. 25 and 26). The sealing part 622 is formed with elastic rubber, for example. When the cartridge 101 has been attached, the sealing part 622 is in contact with the end surface of an outer circumferential wall part 121 of the cartridge 101 and a sealing line that surrounds the ink introduction part 620 is formed. The sealing part 622 biases the cartridge 101 in the direction indicated by the arrow Z.

The electrode part 630 is provided at a corner where the first wall part 601 and the second wall part 602 intersect, and has a terminal surface 631 that faces obliquely upward. A plurality of terminals 632 are arranged on the terminal surface 631 (FIG. 23). The terminal surface 631 of the electrode part 630 is almost parallel with the seventh wall part 117 of the cartridge 101 in the attached state (FIG. 26). Each terminal 632 protrudes in the direction toward the cartridge 101, and comes into electrical contact with the corresponding one terminal 125*t* of the board part 125 of the cartridge 101. Each terminal 632 is electrically connected to the flexible cable 517 of the printer 500.

The protruding part 640 is provided between the ink introduction part 620 and the electrode part 630 (FIG. 24). The protruding part 640 protrudes in the direction indicated by the arrow Z from the first wall part 601. When a cartridge 101 has been attached to the holder part 530, the protruding part 640 is housed in the positioning part 123 that is a recessed part provided in the first wall part 111 of the cartridge 101 (FIG. 26). The protruding part 640 has a size that corresponds to the size of the positioning part 123, and is fitted into the positioning part 123. As a result, the position and the orientation of the cartridge 101 in the holder part 530 are determined.

The rib receiving part 650 is provided as a recessed part in the fourth wall part 604 (FIG. 24). The shape of the opening of the rib receiving part 650 corresponds to the shape of the contour of the rib part 135 provided on the third wall part 113 of the cartridge 101, and includes a first portion 651 that extends in the direction indicated by the arrow Y and a second portion 652 that extends in the direction indicated by the arrow Z. When the cartridge 101 has been attached to the holder part 530, the first portion 135*a* of the rib part 135 is fitted into the first portion 651 of the rib receiving part 650 (FIG. 26), and the second portion 135*b* of the rib part 135 is fitted into the second portion 652 of the rib receiving part 650 (not shown).

The lever 660 is provided on the second wall part 602, and is located above the electrode part 630. The lever 660 is provided so as to be rotatable in the direction indicated by the arrow X. The lever 660 engages with the fitting part 137 that the cartridge 101 has, in the direction that is opposite the direction indicated by the arrow Z. As already described in the description of the configuration of the cartridge 101, the lever 660 has a shape that can engage with the fitting part 137 of the cartridge 101 that is to be attached. Therefore, the lever 660 does not engage with a cartridge 101 that has a fitting part 137 that has a shape that does not correspond to the shape of the lever 660.

When a cartridge 101 is to be attached to the holder part 530, first, the second portion 135*b* of the rib part 135 of the cartridge 101 is inserted into the second portion 652 of the rib receiving part 650, and moves along the second portion 652 in the direction opposite the direction indicated by the arrow Z. Then, the first portion 135*a* of the rib part 135 engages with the first portion 651 of the rib receiving part 650. Subsequently, the seventh wall part 117 side of the cartridge 101 is rotated downward about the first portion 135*a* of the rib part 135 so that the protruding part 640 is fitted into the positioning part 123, while the terminals 125*t* of the board part 125 are brought into contact with the corresponding terminals 632 of the electrode part 630. Then, the lever 660 is rotated toward the cartridge 101 so as to be engaged with the fitting part 137 of the cartridge 101.

Regarding the cartridge 101 in the holder part 530, the first portion 135*a* of the rib part 135 of the third wall part 113 engages with the first portion 651 of the rib receiving part 650, the fitting part 137 of the fourth wall part 114 engages with the lever 660, and thus the movement of the cartridge 101 in the direction indicated by the arrow Z is restricted. Also, the second portion 135*b* of the rib part 135 of the third wall part 113 fits into the second portion 652 of the rib receiving part 650, the protruding part 640 fits into the positioning part 123 of the first wall part 111, and thus the movement of the cartridge 101 in the direction indicated by the arrow X is restricted.

As described above, in the protection-cap-equipped cartridge 100 according to the present embodiment, the contact parts CP of the board part 125 are protected due to the presence of the first engaging part 207 and the second engaging part 208 of the protection cap 102. Therefore, it is possible to prevent failure of electrical contact of the board part 125 to the electrode part 630. Also, due to the presence of the bottom wall part 200 of the protection cap 102, foreign objects are prevented from entering the positioning part 123 before the cartridge 101 has been attached to the carriage 520. Therefore, it is possible to prevent failure of attachment of the cartridge 101 to the carriage 520.

In addition, the outer peripheral wall part 121 formed so as to surround the ink supply part 120 is protected by the protection cap 102, and therefore the sealability with respect to the ink supply part 120 when the cartridge 101 is attached to the carriage 520 is prevented from being degraded. Also, the operation part 212 of the protection cap 102 protrudes in the direction opposite the direction indicated by the arrow Y, and therefore the rib part 135 is protected and failure of attachment of the cartridge 101 to the carriage 520 is prevented from occurring to damage to the rib part 135.

Summary of First Embodiment:

As described above, with the protection-cap-equipped cartridge 100 according to the present embodiment, the contact parts CP and other components of the board part 125 of the cartridge 101 are appropriately protected by the protection cap 102. Also, it is easier to position the engaging parts 207, 208, 213, and 214 when attaching the protection cap 102 to the cartridge 101. Furthermore, the engaging parts 207, 208, 213, and 214 also serve as guides for attaching the protection cap 102 to the cartridge 101, and therefore it is easier to attach the protection cap 102 to the cartridge 101. Also, the protection cap 102 prevents foreign objects from entering the positioning part 123 of the cartridge 101. Ink is prevented from leaking to the outside of the protection-cap-equipped cartridge 100. With the protection-cap-equipped cartridge 100 according to the present embodiment, the engaging parts 207, 208, 213, and 214 improve the stability of the protection cap 102 after having been attached to the cartridge 101. In addition, with the protection cap 102 and the protection-cap-equipped cartridge 100 according to the present embodiment, various effects described in the embodiment above can be achieved.

B. Second Embodiment

Figure 27:
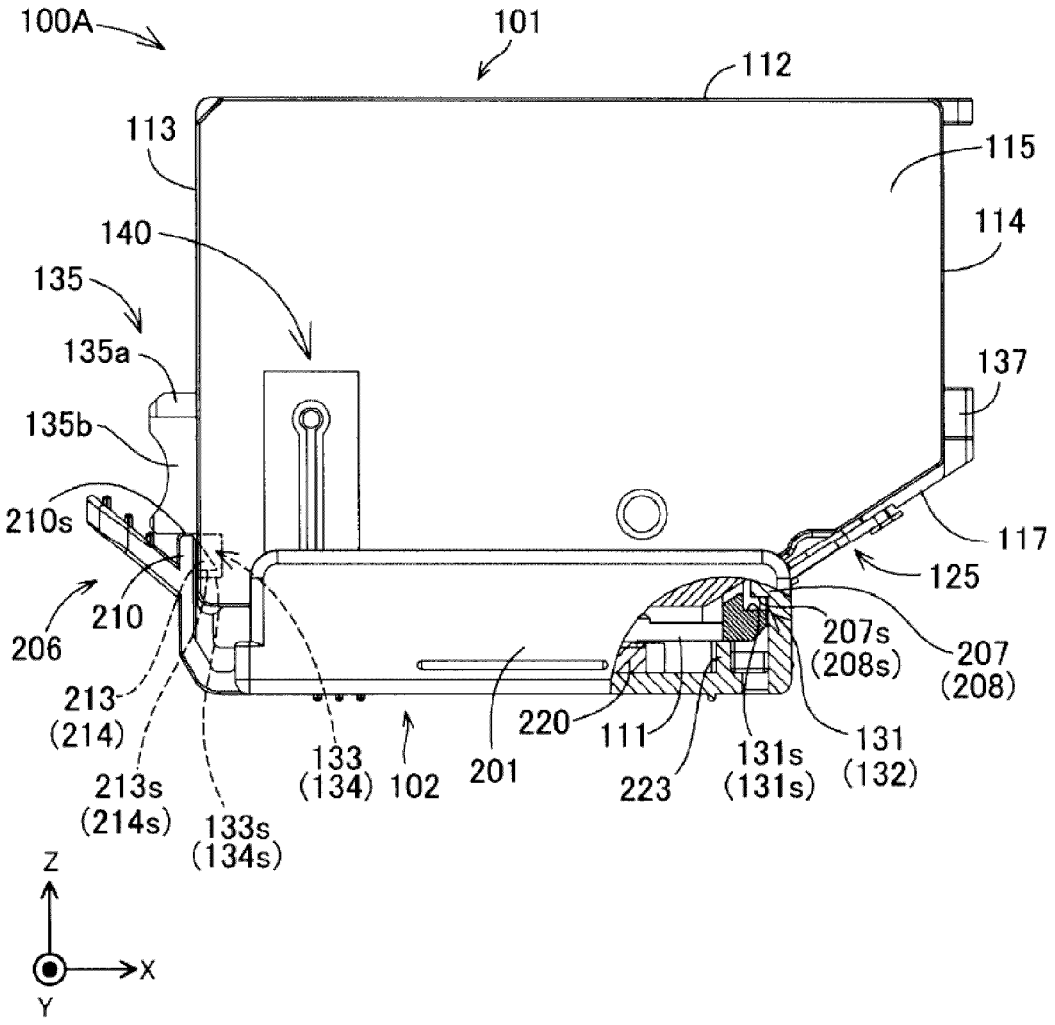
FIG. 27 is a schematic front view showing a configuration of a protection-cap-equipped cartridge according to a second embodiment.

FIG. 27 is a schematic front view showing a configuration of a protection-cap-equipped cartridge 100A according to a second embodiment of the invention. In FIG. 27, a portion of the protection cap 102 is shown in a schematic cross-sectional view in order to show the state of an area between the first engaging part 207 and the sealing part 220 of the protection cap 102. The protection-cap-equipped cartridge 100A according to the second embodiment is almost the same as the protection-cap-equipped cartridge 100 according to the first embodiment except for the points described below.

The protection-cap-equipped cartridge 100A according to the second embodiment is the cartridge 101 described in the first embodiment to which the protection cap 102 described in the first embodiment is attached. In the protection-cap-equipped cartridge 100A, the sealing part 220 is compressed in the direction opposite the direction indicated by the arrow Z, and therefore the cartridge 101 is inserted into the protection cap 102 further in the direction opposite the direction indicated by the arrow Z. With this configuration, the engagement surfaces 207*s*, 208*s*, 213*s*, and 214*s* of the four engaging parts 207, 208, 213, and 214 and the engagement surfaces 131*s* to 134*s* of the corresponding engagement-target parts 131 to 134 are separated from each other in an engageable state.

In the protection-cap-equipped cartridge 100A, the first wall part 111 of the cartridge 101 is in contact with and supported by at least one of the two ribs 223 and 224 provided on the bottom wall part 200 of the protection cap 102. With this configuration, the sealing part 220 is prevented from being excessively compressed, and pressure applied to the sealing part 220 is appropriately maintained. Therefore, the sealability with respect to the ink supply part 120 is prevented from being degraded due to the deterioration of the sealing part 220. Also, in the protection-cap-equipped cartridge 100A, the lower end of the second portion 135*b* of the rib part 135 provided on the third wall part 113 of the cartridge 101 is in contact with the upper end surface 210*s* of the protection wall part 210 of the protection cap 102. With this configuration, the sealing part 220 is further prevented from being subjected to a compression load.

As described above, with the protection-cap-equipped cartridge 100A according to the second embodiment, the sealability of the sealing part 220 is prevented from being degraded. Note that the protection-cap-equipped cartridge 100 according to the first embodiment also has the ribs 223 and 224 and the protection wall part 210 of the protection cap 102 and the rib part 135 of the cartridge 101. Therefore, the protection-cap-equipped cartridge 100 according to the first embodiment also achieves the effect in which the sealability of the sealing part 220 is prevented from being degraded. In addition, with the protection-cap-equipped cartridge 100A according to the second embodiment, various effects that are the same as those described in the first embodiment can be achieved.

C. Modifications

C1. Modification 1:

In the above-described embodiments, the engaging parts 207, 208, 213, and 214 of the protection cap 102 are configured as protruding parts, and the engagement-target parts 131 to 134 of the cartridge 101 are configured as recessed parts. However, the engaging parts 207, 208, 213, and 214 of the protection cap 102 and the engagement-target parts 131 to 134 of the cartridge 101 may have other configurations. For example, the engaging parts 207, 208, 213, and 214 of the protection cap 102 may be configured as recessed parts, and the engagement-target parts 131 to 134 of the cartridge 101 may be configured as protruding parts. Also, it is not necessary for the engaging parts 207, 208, 213, and 214 and the engagement-target parts 131 to 134 to engage with each other through surface contact between the engagement surfaces. The engaging parts 207, 208, 213, and 214 and the engagement-target parts 131 to 134 may engage with each other through line contact or point contact, for example.

C2. Modification 2:

In the above-described embodiments, the first engagement-target part 131 that the first engaging part 207 engages with and the second engagement-target part 132 that the second engaging part 208 engages with are each provided at the lower end of the seventh wall part 117 of the cartridge 101. However, the first engagement-target part 131 and the second engagement-target part 132 may be provided at positions other than the lower end of the seventh wall part 117 of the cartridge 101. The first engagement-target part 131 and the second engagement-target part 132 may be provided at, for example, a position located higher than the board part 125, on the seventh wall part 117. Also, in the cartridge 101, the first engagement-target part 131 and the second engagement-target part 132 do not necessarily have the same height from the first wall part 111, and may be provided at different heights.

C3. Modification 3:

In the above-described embodiments, the four engagement-target parts 131 to 134 of the cartridge 101 are located at positions corresponding to the four corners of the first wall part 111. However, the four engagement-target parts 131 to 134 of the cartridge 101 are not necessarily located at the positions corresponding to the four corners of the first wall part 111. For example, the engagement-target parts 131 to 134 may be located at positions separated from the corners. Also, the four engagement-target parts 131 to 134 may be provided at different heights from the first wall part 111.

C4. Modification 4:

In the above-described embodiments, the protection cap 102 has the four engaging parts 207, 208, 213, and 214. However, the protection cap 102 may be configured with the first engaging parts 207 and 208 on the seventh wall part 117 side and only one engaging part is provided on the third wall part 113 side.

C5. Modification 5:

In the above-described embodiments, the contact parts CP that come into electrical contact with the electrode part 630 of the printer 500 are formed on the terminals 125*t* of the board part 125. However, the contact parts CP are not necessarily formed on the terminals 125*t* of the board part 125, and may be formed on, for example, terminals that are provided directly on a wall surface of the cartridge 101.

C6. Modification 6:

In the above-described embodiments, the positioning part 123 of the cartridge 101 is configured as a recessed part. However, the positioning part 123 is not necessarily configured as a recessed part, and may be configured as a protruding part.

C7. Modification 7:

In the above-described embodiments, the rib part 135 and the fitting part 137 that is a restriction part that restricts the position and the orientation of the cartridge 101 when attached to the carriage 520 of the printer 500 are configured as protruding structures that protrude from a wall surface of the cartridge 101. However, such restriction parts are not necessarily configured as protruding structures, and may be configured as recessed parts or slits, for example. The restriction parts only need to have a shape that corresponds to the shape of fitting-target parts provided for the carriage.

C8. Modification 8:

In the above-described embodiments, the cartridge 101 has the seven wall parts 111 to 117. However, the cartridge 101 does not necessarily have the seven wall parts 111 to 117, and may be constituted by a substantially rectangular shape that has six walls 111 to 116, for example. Alternatively, the cartridge 101 may have a circular column shape, or a substantially triangular pyramid shape.

C9. Modification 9:

In the above-described embodiments, the cartridge 101 has the outer circumferential wall part 121 that surrounds the ink supply part 120. However, the outer circumferential wall part 121 may be omitted.

C10. Modification 10:

In the above-described embodiments, the cartridge 101 is configured as a semi-sealed ink cartridge. However, the cartridge 101 is not necessarily configured as a semi-sealed ink cartridge, and may be configured as an ink cartridge into which external air is taken, as needed, as ink is consumed, for example.

C11. Modification 11:

The cartridge 101 according to the above-described embodiments may be attached to a printer having a configuration that is different from that of the printer 500. The above-described printer 500 is of a so-called on-carriage type printer in which the cartridge 101 is attached to a holder 60 that is provided on the carriage 520 that moves back and forth in the horizontal scanning direction. However, the cartridge 101 may be mounted on a so-called off-carriage type printer. In an off-carriage type printer, the cartridge 101 is attached to a fixed holder that is separated from the carriage, and ink is supplied to the printing head part that the carriage has, via a flexible tube that is connected to the holder.

The invention is not limited to the above-described embodiments, examples, or modifications, and may be realized using various configurations within the scope of the spirit of the invention. The invention may be realized with a liquid container that stores liquid other than ink to be supplied to the printer, for example. The technical features of the embodiments, examples, and modifications that correspond to the technical features of the modes described in SUMMARY may be replaced or combined as appropriate in order to solve some or all of the above-described problems or to achieve some or all of the above-described advantageous effects. Unless technical features are described in the present specification as essential features, the technical features may be omitted as appropriate.

The entire disclosure of Japanese Patent Application No. 2015-231542, filed Nov. 27, 2015, is expressly incorporated by reference herein.

What is claimed is:

1. A liquid container comprising:

a liquid container body that supplies a liquid to a liquid ejection apparatus; and a protection member that is attached to the liquid container body, wherein the liquid container body includes:

a liquid supply port that allows the liquid to pass therethrough;

a plurality of contact parts that are to be in contact with an electrode part of the liquid ejection apparatus; and a first engagement-target part and a second engagement-target part that the protection member engages with, the protection member includes:

a sealing part that faces the liquid supply port;

a first engaging part that engages with the first engagement-target part; and a second engaging part that engages with the second engagement-target part, and when a first direction denotes a direction in which the sealing part faces the liquid supply port, a second direction denotes a direction that is orthogonal to the first direction and is a direction from the liquid supply port to the plurality of contact parts, and a third direction denotes a direction that is orthogonal to the first direction and the second direction, the plurality of contact parts viewed in the first direction are located between the first engaging part and the second engaging part in terms of the third direction.

2. The liquid container according to claim 1, wherein a distance between the first engaging part and the second engaging part in the third direction is greater than a maximum distance between the plurality of contact parts in the third direction, and a difference between: the distance between the first engaging part and the second engaging part in the third direction; and the maximum distance between the plurality of contact parts in the third direction is smaller than a width of the first engagement-target part in the third direction.

3. The liquid container according to claim 1, wherein the liquid container body includes a board on which the plurality of contact parts are arranged, and when viewed in the first direction, the board is located between the first engaging part and the second engaging part in terms of the third direction.

4. The liquid container according to claim 3, wherein a distance between the first engaging part and the second engaging part in the third direction is greater than a width of the board in the third direction, and a difference between: the distance between the first engaging part and the second engaging part in the third direction; and the width of the board in the third direction is smaller than a width of the first engagement-target part in the third direction.

5. The liquid container according to claim 3, wherein $W2<D1+D2<W1+W2$ is satisfied, where D1 denotes a distance between the board and the first engaging part in the third direction, D2 denotes a distance between the board and the second engaging part in the third direction, W1 denotes a width of the first engagement-target part in the third direction, and W2 denotes a distance between the board and the first engagement-target part in the third direction.

6. The liquid container according to claim 3,
wherein a width W3 of the first engaging part in the third direction is greater than a distance W2 between the board and the first engagement-target part in the third direction.

7. The liquid container according to claim 6,
wherein a width W4 of the second engaging part in the third direction is greater than a distance W5 between the board and the second engagement-target part in the third direction.

8. The liquid container according to claim 1,
wherein the liquid container body further includes a positioning part that determines a position of the liquid container body when attached to the liquid ejection apparatus, and
in terms of the second direction, the positioning part is located between the liquid supply port and the plurality of contact parts, and between the liquid supply port and a pair of the first engagement-target part and the second engagement-target part, and is covered by a portion of the protection member.

9. The liquid container according to claim 1,
wherein the liquid container body further includes:
a fitting part that has a shape corresponding to a shape of a fitting-target part of the liquid ejection apparatus, and that fits to the fitting-target part; and
a third engagement-target part and a fourth engagement-target part that engage with the protection member,
the protection member further includes:
a third engaging part that engages with the third engagement-target part; and
a fourth engaging part that engages with the fourth engagement-target part, and
when viewed in the first direction,
the liquid supply port is located between the plurality of contact parts and the fitting part in terms of the second direction, and
the fitting part is located between the third engaging part and the fourth engaging part in terms of the third direction.

10. The liquid container according to claim 9,
wherein when viewed in the first direction, the liquid supply port is located within an area that is surrounded by the first engaging part, the second engaging part, the third engaging part, and the fourth engaging part.

11. The liquid container according to claim 1,
wherein the liquid container body includes:
a first wall part;
a second wall part that faces the first wall part;
a third wall part that intersects the first wall part and the second wall part;
a fourth wall part that intersects the first wall part and the second wall part, and faces the third wall part;
a fifth wall part that intersects the first wall part, the second wall part, the third wall part, and the fourth wall part;
a sixth wall part that intersects the first wall part, the second wall part, the third wall part, and the fourth wall part, and faces the fifth wall part; and
a seventh wall part that intersects the first wall part, the second wall part, the fifth wall part, and the sixth wall part, and is located between the first wall part and the fourth wall part,
the liquid supply port, the first engagement-target part, and the second engagement-target part are provided for the first wall part,
the plurality of contact parts are provided for the seventh wall part,
the third wall part is provided with a rib,
the rib includes a first portion that extends in the third direction and a second portion that extends toward the first wall part from the first portion,
the protection member includes:
a main body part that faces the first wall part; and
a movable part that is connected to the main body part,
the sealing part, the first engaging part, and the second engaging part are provided for the main body part,
the movable part is provided with an operation part that is used for removing the protection member from the liquid container body, and
a portion of the movable part abuts against the second portion in the first direction.

12. A liquid container comprising:
a liquid container body that supplies a liquid to a liquid ejection apparatus; and
a protection member that is attached to the liquid container body,
wherein the liquid container body includes:
a liquid supply port that allows the liquid to pass therethrough;
a plurality of contact parts that are to be in contact with an electrode part of the liquid ejection apparatus;
a positioning part that determines a position of the liquid container body when attached to the liquid ejection apparatus; and
a first engagement-target part and a second engagement-target part that the protection member engages with,
the protection member includes:
a sealing part that faces the liquid supply port;
a first engaging part that engages with the first engagement-target part; and
a second engaging part that engages with the second engagement-target part, and
when a first direction denotes a direction in which the sealing part faces the liquid supply port, a second direction denotes a direction that is orthogonal to the first direction and is a direction from the liquid supply port to the plurality of contact parts, and a third direction denotes a direction that is orthogonal to the first direction and the second direction,
in terms of the second direction, the positioning part is located between the liquid supply port and the plurality of contact parts, and between the liquid supply port and a pair of the first engagement-target part and the second engagement-target part, and is covered by a portion of the protection member.

13. A liquid container comprising:
a liquid container body that supplies a liquid to a liquid ejection apparatus; and
a protection member that is attached to the liquid container body,
wherein the liquid container body includes:
a liquid supply port that allows the liquid to pass therethrough;
a plurality of contact parts that are to be in contact with an electrode part of the liquid ejection apparatus;
a fitting part that has a shape corresponding to a shape of a fitting-target part of the liquid ejection apparatus, and that fits to the fitting-target part; and
a pair of engagement-target parts that the protection member engages with, the protection member includes:

a sealing part that faces the liquid supply port; and a pair of engaging parts that respectively engage with the pair of engagement-target parts, and when a first direction denotes a direction in which the sealing part faces the liquid supply port, a second direction denotes a direction that is orthogonal to the first direction and is a direction from the liquid supply port to the plurality of contact parts, and a third direction denotes a direction that is orthogonal to the first direction and the second direction, when viewed in the first direction, the liquid supply port is located between the plurality of contact parts and the fitting part in terms of the second direction, and the fitting part is located between the pair of engaging parts in terms of the third direction.

14. The liquid container according to claim 13, wherein the pair of engaging parts each have a shape that protrudes toward the liquid container body in the third direction, and are configured to abut against the liquid container body before coming into contact with the pair of engagement-target parts during a process in which the protection member is attached to the liquid container body.

* * * * *